US008661581B2

(12) United States Patent
Kaplan et al.

(10) Patent No.: US 8,661,581 B2
(45) Date of Patent: Mar. 4, 2014

(54) CRIB LINER SYSTEM

(71) Applicant: Triboro Quilt Manufacturing Corp., White Plains, NY (US)

(72) Inventors: Joel Kaplan, White Plains, NY (US); Richard White, Dayton, OH (US); Jonathan Daugherty, Dayton, OH (US); Deborah Ashworth, Dayton, OH (US)

(73) Assignee: Triboro Quilt Manufacturing Corp., White Plains, NY (US)

( * ) Notice: Subject to any disclaimer, the term of this patent is extended or adjusted under 35 U.S.C. 154(b) by 0 days.

(21) Appl. No.: 13/649,204

(22) Filed: Oct. 11, 2012

(65) Prior Publication Data

US 2013/0097784 A1 Apr. 25, 2013

Related U.S. Application Data

(63) Continuation-in-part of application No. 13/463,966, filed on May 4, 2012.

(60) Provisional application No. 61/483,434, filed on May 6, 2011, provisional application No. 61/503,893, filed on Jul. 1, 2011.

(51) Int. Cl.
*A47D 15/00* (2006.01)

(52) U.S. Cl.
USPC ..... 5/93.1; 5/946; 5/427; 5/424; 5/425

(58) Field of Classification Search
USPC ..... 5/424, 425, 427, 93.1, 946
See application file for complete search history.

(56) References Cited

U.S. PATENT DOCUMENTS

| | | | | |
|---|---|---|---|---|
| 3,018,492 | A * | 1/1962 | Rosen | 5/93.1 |
| 4,370,765 | A | 2/1983 | Webber | |
| 5,044,025 | A * | 9/1991 | Hunsinger et al. | 5/424 |
| 5,241,718 | A | 9/1993 | Pope | |
| 5,421,046 | A | 6/1995 | Vande Streek | |
| 5,533,715 | A * | 7/1996 | Dandrea | 256/45 |
| 5,761,756 | A * | 6/1998 | Nowak et al. | 5/426 |
| 5,806,112 | A * | 9/1998 | Harms | 5/93.1 |
| 5,898,964 | A | 5/1999 | Stanley | |
| 5,933,885 | A * | 8/1999 | Glassford | 5/424 |
| 5,960,493 | A * | 10/1999 | Rhey et al. | 5/424 |
| 5,991,944 | A * | 11/1999 | Yang | 5/99.1 |
| 6,272,771 | B1 * | 8/2001 | Rodi | 36/77 R |
| 6,772,457 | B1 | 8/2004 | Alaback | |
| 7,213,282 | B1 * | 5/2007 | Wojtowicz | 5/93.1 |
| 2001/0000362 | A1 | 4/2001 | Wagner et al. | |
| 2002/0178500 | A1 * | 12/2002 | Koenig | 5/424 |

(Continued)

*Primary Examiner* — Peter M Cuomo
*Assistant Examiner* — Ifeolu Adeboyejo
(74) *Attorney, Agent, or Firm* — Leason Ellis LLP

(57) ABSTRACT

A crib liner is provided for a crib that includes a plurality of sides and four corner posts. The liner includes a body that has a pair of opposing first panel sections for placement along two sides and a pair of opposing second panel sections for placement along the other two sides. Each panel section is defined by a top edge and an opposite bottom edge, wherein a length of the top edge is different than a length of the bottom edge for each of the panel sections. The body is configured for placement inside of the crib along inner surface of the sides of the crib. The liner is attached to the inside of the crib by a plurality of fasteners, each fastener being configured to attach around one corner post for securely attaching the liner body to the crib.

27 Claims, 29 Drawing Sheets

(56) References Cited

U.S. PATENT DOCUMENTS

2004/0154099 A1* 8/2004 Waters et al. ..... 5/424
2008/0216233 A1 9/2008 Butlin
2009/0211023 A1 8/2009 Cocco et al.
2009/0313755 A1 12/2009 Burrell, VI

* cited by examiner

Fig. 6B
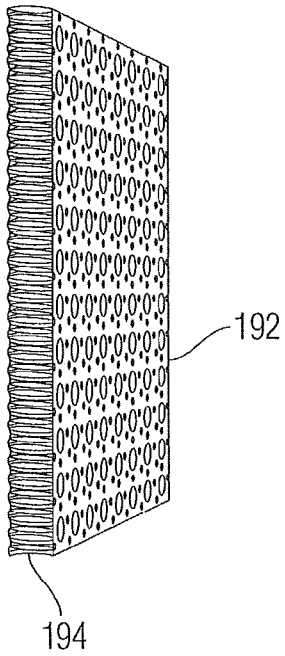
Fig. 6A
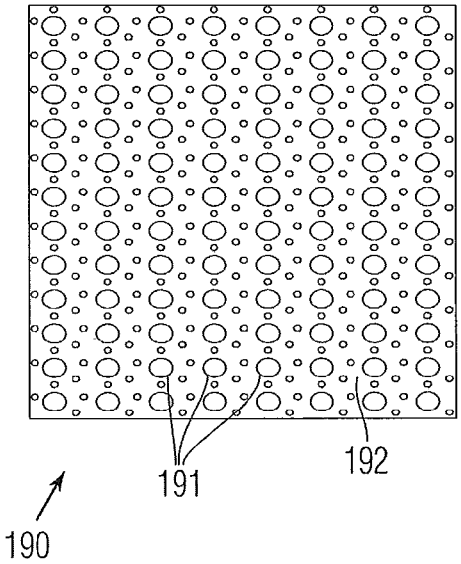
Fig. 6C
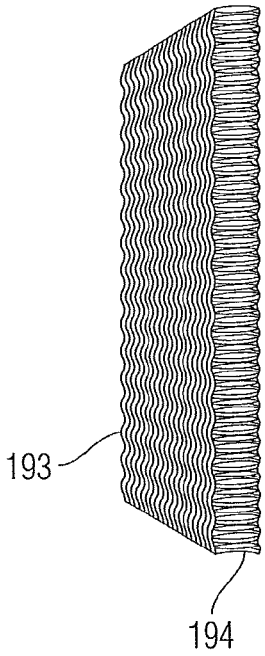
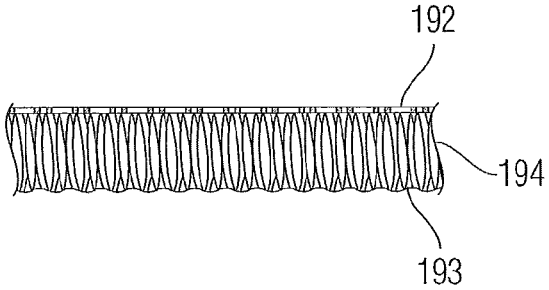
Fig. 6D

Fig. 25
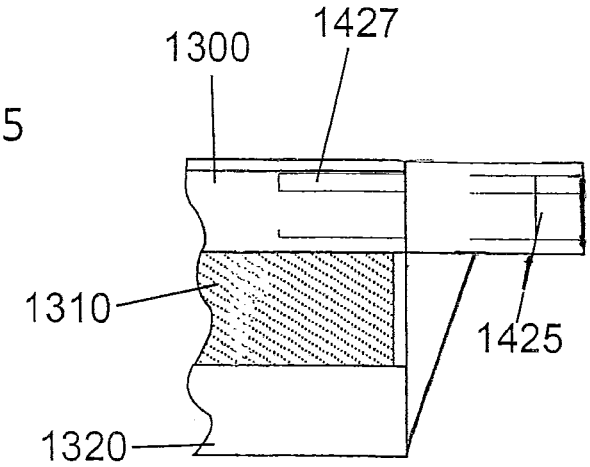
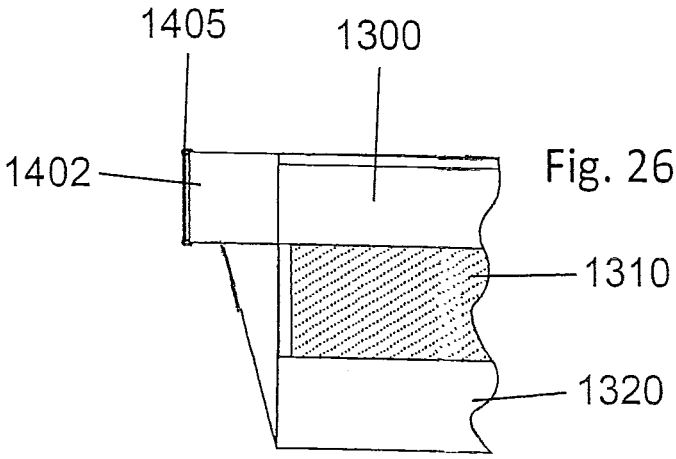
Fig. 26

CRIB LINER SYSTEM

CROSS REFERENCE TO RELATED APPLICATION

The present application is a continuation-in-part of U.S. patent application Ser. No. 13/463,966, filed May 4, 2012, which claims the benefit of and priority to U.S. patent application Nos. 61/483,434, filed May 6, 2011 and 61/503,893, filed Jul. 1, 2011, each of which is hereby incorporated by reference in its entirety.

TECHNICAL FIELD

The present invention relates to crib related products and in particular, to crib attachments that are designed to prevent or protect infants or young children when in a crib from potentially problematic situations, such as getting limbs extended and caught between crib slats, etc., and at the same time provide an aesthetically pleasing product.

BACKGROUND

As is well known, an infant bed (commonly referred to as a crib) is a small bed that is specifically designed for infants and very young children. Cribs are designed to safely restrict the infant to the crib and therefore, are designed so that the sides are too high for an infant to climb and no footholds are provided. Cribs are also designed to prevent limb entrapment and consequently, in many countries, government agencies that oversee product safety have enacted standards for cribs. For example, typical standards include requirements that concern the size and spacing of the vertical bars or slats on the sides and ends and also the distance between the top of the side and the top of the mattress support in different operating positions.

Conventional baby cribs include side rails that are made up of top and bottom horizontal bars interconnected by a series of spaced apart slats. Frequently babies and toddlers while sleeping or playing in their cribs intentionally or accidentally extend their limbs out of the crib between the slats and can have difficulty drawing them back into the crib. If this occurs when the child is sleeping, the extended limbs will remain uncovered and become cold, and the child will ultimately awaken. In addition, the child could potentially be injured or caused discomfort by having a limb become temporarily lodged between a pair of slats. Most conventional cribs also include headboards and footboards that also can be made with spaced-apart supports (similar to side rails) and as a result, the infant can extend a limb between these supports as well.

While once popular, one style of crib that was commonly known as a "drop-side" crib has been recently banned in the United States due to safety concerns resulting from the drop-down side portion thereof. As a result, the prevalent crib design of the day is a fixed crib structure that most often includes two side rail sections and a footboard/headboard or some other structure that closes off one end of the crib. For example, some cribs include an integral changing station which is fixedly attached to one end of the crib and provides a vertical wall that closes off that end of the crib's sleeping area.

In addition to a mattress, there are a vast number of different crib accessory products that are sold for use with a crib. These accessory products can range from toys, such as mobiles, to comfort products, such as quilts and bedding and to safety products that are designed to address potential safety concerns and/or provide additional protection for the infant in the crib. For example, one type of product that is popular is a crib shield/crib bumper that is disposed across at least a portion of the crib. "Crib bumpers" are marketed to keep children from bumping against the hard sides and hurting themselves and keeping arms and legs inside of the crib. Crib bumpers can be formed in different styles and using different materials. For example, traditional crib bumpers can be formed from a number of different materials, including natural materials (e.g., cotton or bamboo) or synthetic materials (e.g., polyester) that provide a padded product that protects the infant from the hard sides. Crib bumpers can be marketed as part of a matching bedding set and therefore, often include decorative patterns or decorative indicia, such as animals, etc. Many parents like the decorative look of the traditional crib bumpers.

In addition and more recently, crib shields/crib bumpers can be formed of a mesh material that is intended to provide increased ventilation. These products can be in the form of a breathable integrated padded mesh material. However, these mesh products lack the decorative appearance of more traditional crib bumpers. Most times, the mesh product is in the form a plain mesh panel that lacks any ornamental detail or only includes minor ornamental detail.

SUMMARY

In one embodiment, a crib liner for a crib is provided. The crib includes a plurality of sides and four corner posts. The liner includes a body that has a pair of opposing first panel sections for placement along two sides and a pair of opposing second panel sections for placement along the other two sides. Each panel section is defined by a top edge and an opposite bottom edge, wherein a length of the top edge is different than a length of the bottom edge for each of the panel sections. The body is configured for placement inside of the crib along inner surface of the sides of the crib. The liner is attached to the inside of the crib by a plurality of fasteners, each fastener being configured to attach around one corner post for securely attaching the liner body to the crib.

In another embodiment, a crib liner is provided for a crib that includes sides and four corner posts. The liner includes a body having a pair of opposing first panel sections for placement along two sides of the crib and a pair of opposing second panel sections for placement along the other two sides of the crib. The body is configured for placement inside of the crib along inner surfaces of the sides of the crib. The liner includes a plurality of fasteners for attaching the liner to the crib. Each fastener is configured to attach around one corner post for securely attaching the liner body to the inner surfaces of the crib. Each fastener includes a first member and a second member being located in one corner of the liner. The first and second members are configured to mate together to define a looped structure that extends around the corner post and has an adjustable circumference so as to capture and accommodate different sized corner posts by adjustment of the circumference of the looped structure.

These and other aspects, features and advantages shall be apparent from the accompanying Drawings and description of certain embodiments of the invention.

BRIEF DESCRIPTION OF THE DRAWINGS

FIG. 6A-6D show details of one embodiment of an integrated padded mesh material that may be used in forming at least a portion of a crib liner according to one embodiment of the present invention;

FIG. 25 is a first section of the crib liner of FIG. 24 which defines a part of one corner;

FIG. 26 is a second section of the crib liner of FIG. 24 which defines another part of the corner;

DETAILED DESCRIPTION OF CERTAIN EMBODIMENTS OF THE INVENTION

Figure 1:
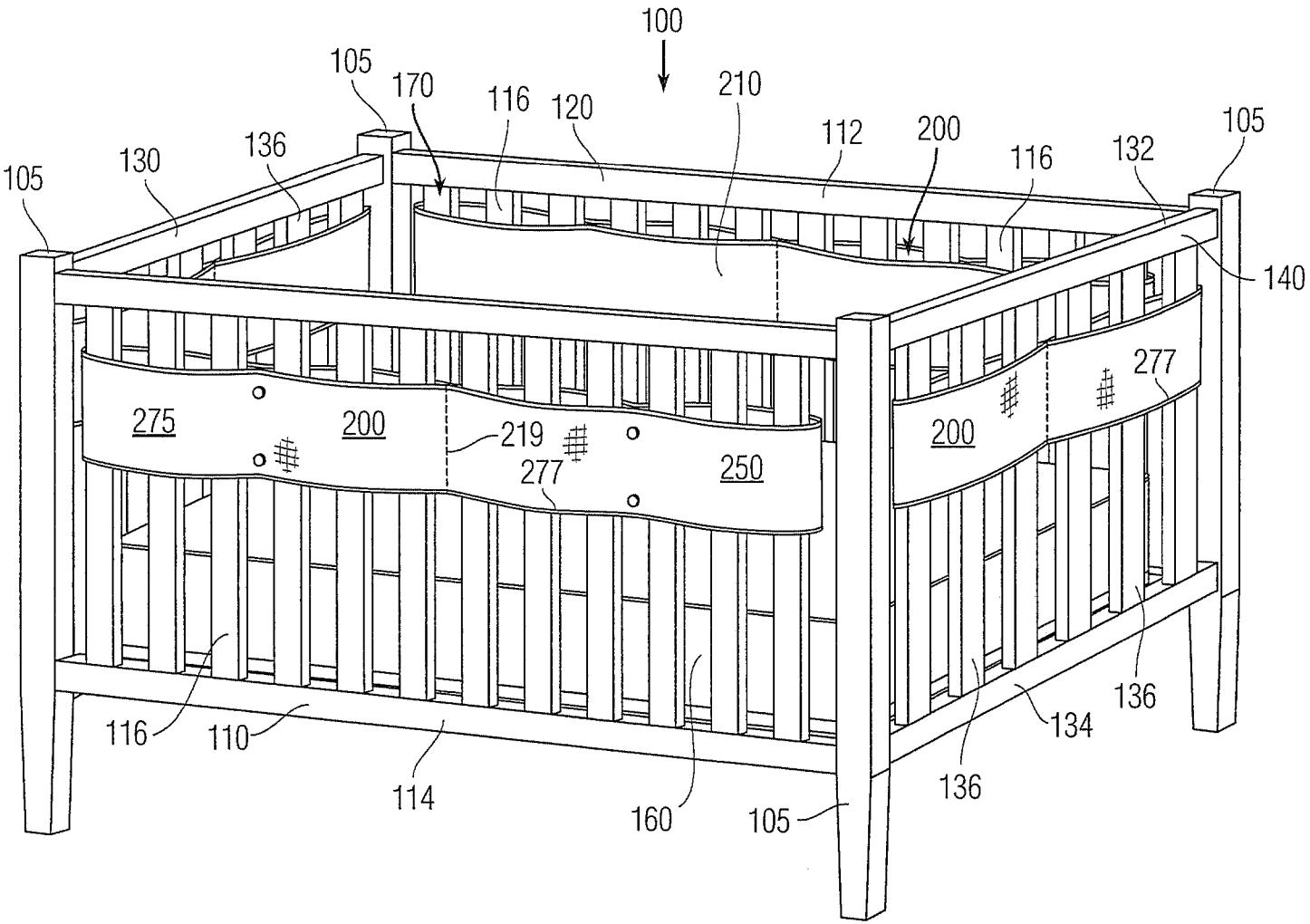
FIG. 1 is a side perspective view of a crib liner according to one embodiment attached to a crib.

FIG. 1 shows a conventional crib 100 that includes two side rails 110, 120, a footboard 130 and a headboard 140. The side rails 110, 120 extend between the footboard 130 and the headboard 140 along a length thereof. The headboard 140, footboard 130 and side rails 110, 120 are connected and sized for receiving a mattress 160 within an interior 170 of the crib 100. It will be understood that the crib 100 can be of a permanent type or can be of a foldable or portable type.

Generally, the side rails 110, 120, footboard 130, and headboard 140 define an interior boundary extending proximate and around a periphery of the mattress 160 disposed within the crib 100. The mattress 160 is supported within the crib 100 by various structures not shown in FIG. 1. For example, a bottom structural member may be supported at one or more positions about the interior boundary of the crib 100. In many conventional cribs 100, the mattress 160 and/or a supporting member there below may be raised and/or lowered. The crib 100 includes four corner posts 105.

Each of the side rails 110, 120 generally includes a top bar 112 and a bottom bar 114 positioned substantially parallel to one another. A plurality of generally vertically-spaced side support elements 116 extend between the horizontal top bar 112 and horizontal bottom bar 114. The side rails 110, 120 are fixedly attached to the other components of the crib, such as the footboard 130 and headboard 140.

The headboard 140 of crib 100 includes an upper bar 132 as well as a bottom horizontal element 134, each connected in a fixed position to a pair of the corner posts 105. In a similar manner to the side rails 110, 120, generally vertically-spaced support elements 136 extend between the top bar 132 and the bottom horizontal element 134. In the illustrated embodiment, the footboard 130 has a similar or identical construction and includes an upper bar 132 as well as a bottom horizontal element 134, each connected in a fixed position to a pair of the corner posts 105. Vertically-spaced support elements 136 extend between the top bar 132 and the bottom horizontal element 134.

However, it will be recognized that some cribs may or may not have spaced support elements 136 that define a part of the footboard 130 or headboard 140. For example, the headboard 140 and footboard 130 can be formed of a solid material as opposed to spaced-apart supports. The footboard 130 is configured in a manner like that of the headboard 140 and includes corner posts 105.

As shown in FIG. 1, the plurality of spaced-apart side support elements 116 of the side rails 110, 120 and the support elements 136 of the headboard and footboard 140, 130 are used to define the interior boundary extending proximate and around the periphery of the mattress 160 disposed within the crib 100.

In accordance with the present invention, a crib liner or crib shield 200 is provided for use with crib 100 and more particularly, the crib liner 200 is attached to the crib 100 along at least some portions of the interior boundary of the crib 100 defined by the side rails 110, 120, headboard 140 and footboard 130.

In the embodiment illustrated in FIGS. 1-5, the crib liner 200 comes as a set of liners or panel sections for attachment to the crib 100. For example, the crib liner set can include two or more crib liners 200 that are used for covering portions of the crib 100. For example, one crib liner 200 can be attached to the crib 100 such that it extends along at least a length of the side rail 110 and optionally along one or both of the headboard 140 and the footboard 130 and another crib liner 200 can be attached to the crib 100 such that it extends along the other side rail 120 and optionally along one or both of the headboard 140 and the footboard 130.

In the illustrated embodiment, the crib 100 includes four separate liners 200 that are attached about the periphery of the crib 100 and in particular, a first liner 200 is attached to one side rail 110; a second liner 200 is attached to another side rail 120; a third liner 200 is attached to the headboard 140 and a fourth liner 200 is attached to the footboard 130. However, as described above, this is merely one embodiment and other crib liner systems can include less than four (4) panels, e.g., one or two crib liners attached to one or more sections of the crib.

Figure 3:
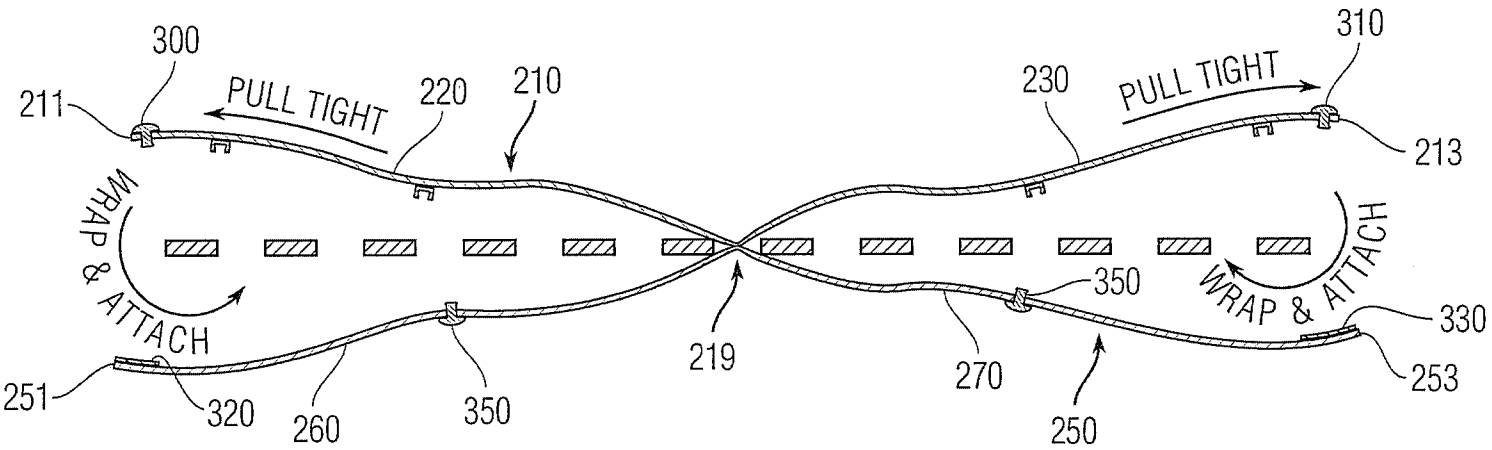
FIG. 3 is a top view, in cross-section, of the crib liner of FIG. 1 showing a first exemplary step for attaching the crib liner to a section of the crib.
Figure 4:
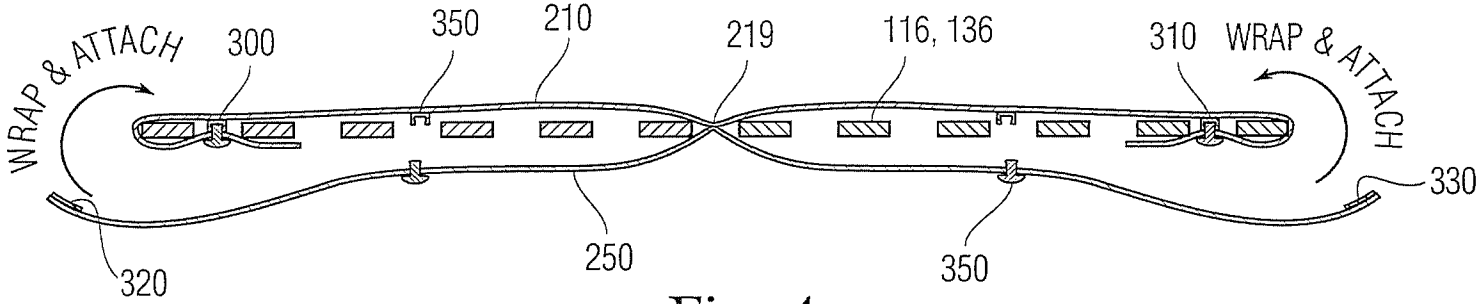
FIG. 4 is a top view, in cross-section, of the crib liner of FIG. 1 showing a second exemplary step for attaching the crib liner to the crib section.
Figure 5:
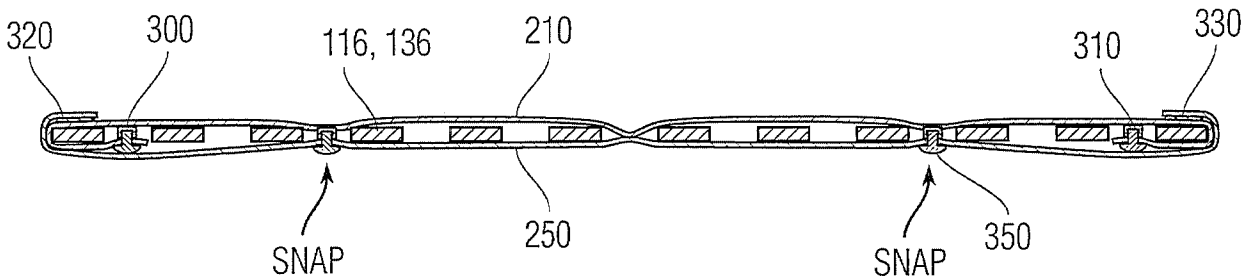
FIG. 5 is a top view, in cross-section, of the crib liner of FIG. 1 showing a third exemplary step for attaching the crib liner to the crib section.

According to one embodiment, the crib liner 200 can be thought of as being a multi-layer structure when attached to the crib 100 that includes a number of integral or separate sections. As shown in the figures, the crib liner 200 can be broadly thought of as having an inner section 210 that faces the infant and an opposing outer section 250 that faces away from the infant. The portion of the crib 100 to which the crib liner 200 is attached is at least partially disposed between the inner section 210 and the outer section 250. For example, vertical support elements 116, 136 can be disposed between the inner section 210 and the outer section 250 and as shown in FIGS. 3-5, the vertical support elements 116, 136 are at least partially captured between the inner section 210 and the outer section 250 as a result of the inner and outer sections 210, 250 being attached to the crib. In other words, the crib liner 200 is designed such that a first portion (inner section 210) of the crib liner 200 extends along the interior of the crib (i.e., along the inside of support elements of the crib) and a different second portion (outer section 250) extends along the exterior of the crib (i.e., along the outside of support elements of the crib) and more particularly, the first and second portions extend along a substantial length of one or more of the side rails 110, 120, headboard 140, and footboard 130. As described herein, the first portion (inner section 210) provides a safety feature that utilizes the presence of the support elements between the first and second portions to provide improved breathability, while the second portion (second section 250) can provide a decorative component to the crib liner 200.

As described in detail below, in one embodiment, the inner section 210 has different material properties compared to the outer section 250 and in particular, the inner section 210 is formed of a material that has increased breathability compared to the outer section 250 and the outer section 250 preferably is formed of a material which is more suitable for the provision of decorative features, such as printed indicia, formed at least along an exterior surface of the outer section 250.

The decorative indicia can be applied using any number of conventional techniques, including printing, embroidery, stitching, etc.

The crib liner 200 has the following dimensions: height (H); length (L), as well as a thickness (T).

Figure 12:
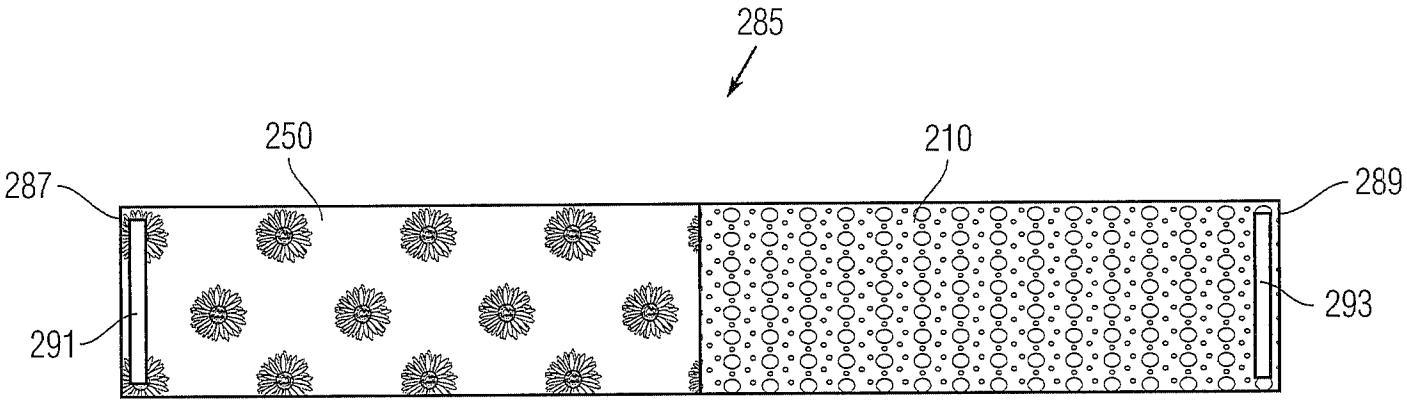
FIG. 12 is a side elevation view of a crib liner according to yet another exemplary embodiment in a fully extended position.

The inner section 210 of the crib liner 200 can be defined by a plurality of panels that are adjacent one another and interface one another at one or more select locations to form an elongated panel structure (FIG. 12). Alternatively, the inner section 210 can be formed of a single panel structure and the first seam 219 is eliminated.

In addition, the permanent seam 219 can be eliminated and the inner section 210 and the outer section 250 can have no permanent attachment points but instead be two separate panel structures that are joined at their ends about the crib frame so as to position the inner section 210 (first panel) within the crib interior and the outer section 250 (second panel) along the exterior of the crib. The attachment at the ends and optionally at intermediate points results from using fastening elements of the type described herein and of a detachable type.

In the illustrated embodiment shown in FIGS. 3-5, the inner section 210 of the crib liner 200 includes a first panel 220 and a second panel 230 that are defined and separated by a first seam 219 or the like. The first and second panels 220, 230 can be uniform or they can be different from one another. In the illustrated embodiment, the first and second panels 220, 230 are at least substantially uniform and are generally square or rectangular shaped. However, it will be understood that the panels can be formed to have other shapes so long as they perform the intended function. For example, one or more of the panels of the crib liner 200 can have a decorative look, such as having a decorative shape. It will therefore be appreciated that the first and second panels 220, 230 are defined (formed) as a result of the inclusion of the seam 219 and in fact, the inner section 210 is preferably formed as a single continuous elongated structure with no discernable panels prior to joining the inner section 210 with the outer section 250 along the first seam 219.

Each panel 220, 230 is defined by a main body 225 and trim 215 or the like can extend about a boundary of the inner section 210 such that the trim 215 surrounds the main body 225. It will be appreciated that the trim 215 can be formed of a material that is different than the material that forms the main body 225. In the illustrated embodiment, the trim 215 can be in the form of a pair of horizontal strips of material that extend along top and bottom edges of the main body 225 and a pair of vertical strips of material that along to end edges of the main body 225.

In accordance with the present invention, the inner section 210 is formed of a material that has enhanced breathability and in particular, the inner section 210 is formed of a mesh material. The mesh material used to construct at least a portion of the inner section 210 can include any suitable mesh-type material that provides breathable functionality. Breathable functionality refers to the ability of the material to allow air to substantially move effectively therethrough. As used herein, when air is indicated as substantially moving effectively through a material, it is meant that the material includes openings (e.g., mesh openings, open-framework, spaces between elements thereof, or even those that may not be visually perceivable openings but still allow a breathable function to occur) that do not impede air movement to an extent that would prevent a human being from breathing through (e.g., when a human's respiratory openings (e.g., nose/mouth) are in direct contact with a material) such a material in order to prevent suffocation and further that such openings are too small to permit an infant to insert a finger or toe therethrough. For example, such materials may include cotton, silk, polyester, nylon, etc.

In one embodiment, the first section 210 is formed of a mesh material that is formed of openings too small to permit an infant to insert a finger or toe therethrough. It will also be appreciated that when mesh material is discussed herein with reference to other crib liners, one exemplary type of mesh is thus one in which the mesh material that is formed of openings too small to permit an infant to insert a finger or toe therethrough.

In one embodiment, the inner section is formed of a single layer mesh material that has suitable sized openings for the intended application. Alternatively, the mesh-type material can be a breathable integrated padded mesh material (e.g., a padded spacer mesh) 190, such as that shown generally in FIGS. 6A-6D. The breathable integrated padded mesh material 190 includes openings 191 on a front substructure thereof 192, as shown in top view of the material of FIG. 6A. As shown in the cross-section of the breathable integrated padded mesh material 190 in FIG. 6D, the material further includes a back substructure 193 and a pile substructure 194 is integrated with and extends between the front and back substructures 192, 193. Each of the substructures 192, 193 (e.g., the front, back, and pile substructures) allows air to substantially move effectively therethrough.

It will be recognized that the thickness of the padded mesh material may vary, as well as for other materials described herein. For example, more padding may create a softer more plush effect with slightly different breathability/ventilation properties and more opaqueness (e.g., less light transmissive) whereas less padding may create more breathability and buoyancy with less opaqueness (e.g., more light transmissive). Preferably, the panels described herein are at least somewhat transparent such that at least motion of the child in the crib can be seen.

The padded mesh material can also be collapsible. As such, when installed or uninstalled, should a child stand on it, the material will collapse. This reduces the risk of the mesh material being used as a means for an infant to climb upwardly in the crib and potentially fall out of the crib 100.

Figure 8:
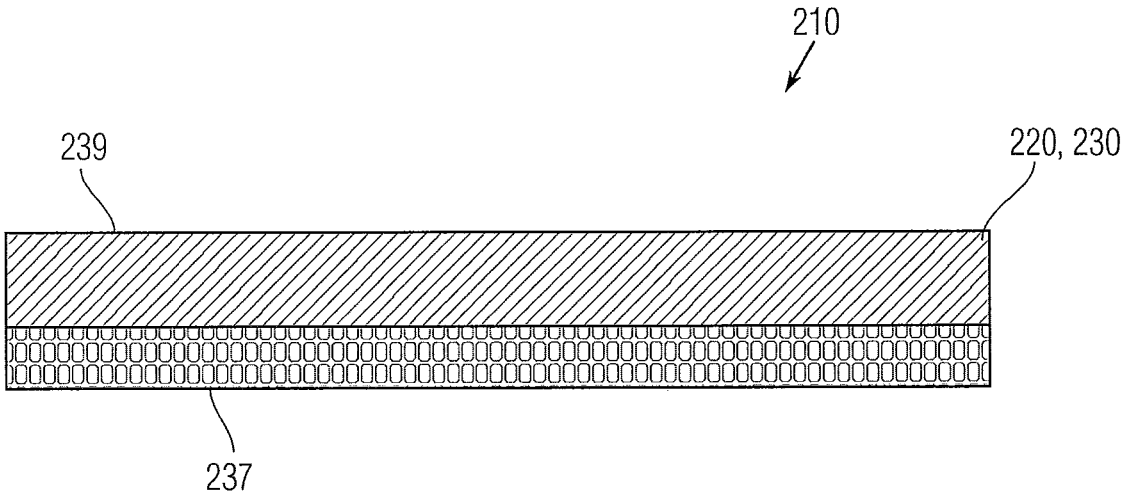
FIG. 8 is a side elevation view of a section for a crib liner according to one exemplary embodiment.

As described in more detail herein, it will be appreciated that at least a portion of the inner section 210 is formed of the mesh material and preferably, a majority of the inner section 210 is formed of mesh material. It will be appreciated that the inner section 210 can include material other than mesh, such as material used for decorative or other trimming purposes. However, such other material is kept to portions that are smaller than those which may potentially block breathing of child (e.g., through the mouth and nose of a child) and/or the other material is located at a position that is not exposed to the breathing child during normal use of the crib 100. For example and as shown in FIG. 8, one or more panels 220, 230 of the inner section 210 can include a first lower section 237 that is formed of a mesh material and a second upper section 239 that is formed of a non-mesh material. The relative heights of the sections 237, 239 are selected such that during normal use of the crib, the child's nose and mouth are positioned adjacent to the lower section 237 which is formed of the mesh material. The non-mesh section (upper section 239) is thus located above the child's nose and mouth when the child lies on the mattress 160.

Figure 2:
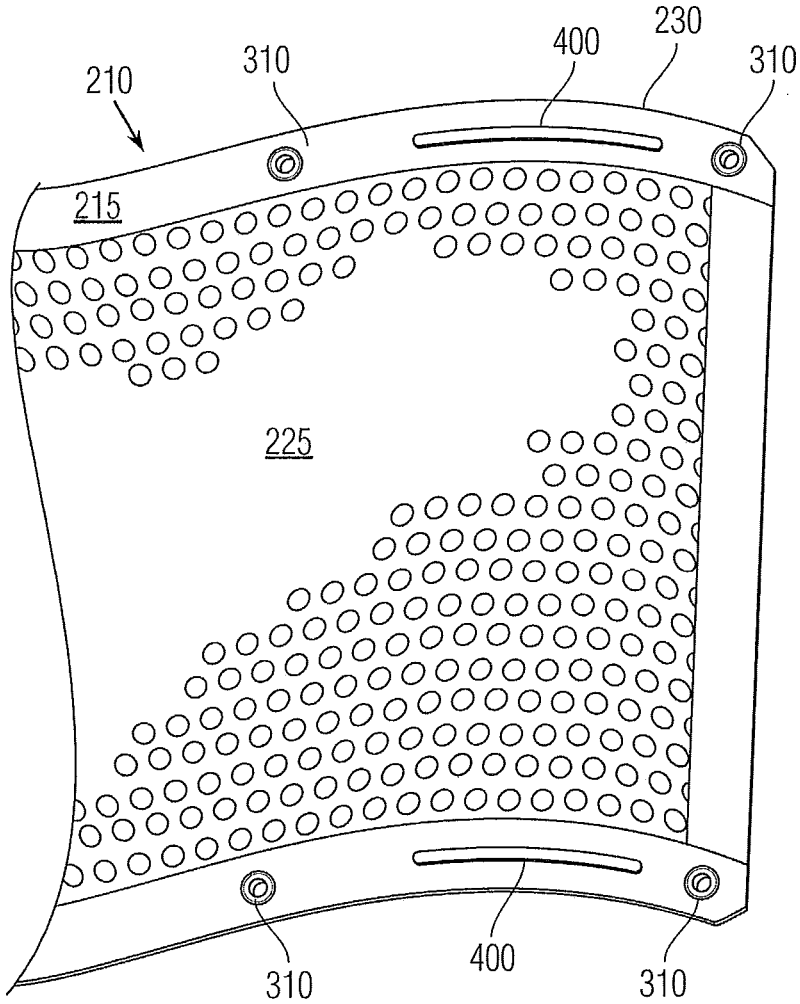
FIG. 2 is a side view of one end section of one portion of the crib liner of FIG. 1.

For example, the panel can be constructed such that at least half of the panel is made up of the first lower section 237 (thus the mesh material occupies at least half the panel as measured along its height). In another embodiment, a portion of the inner section 210 is formed of a mesh material. As described herein, a pre-selected portion, less than the entire portion, of the inner section is formed of a mesh material. In yet another embodiment, the entire main body portion 225 is formed of mesh material with only the trim or the like being formed of a different material. FIG. 2 shows this embodiment in which the entire body portion 225 is formed of a mesh material.

It is also within the scope of the present invention that the inner section 210 can be formed of at least two different types of mesh material. For example, the first lower section 237 can be formed of one type of mesh material (e.g., breathable integrated padded mesh material) and the second upper section 239 can be formed of another type of mesh material (e.g., a simple mesh as opposed to an integrated padded mesh material).

The outer section 250 of the crib liner 200 can be defined by a plurality of panels that are adjacent one another and interface one another at one or more select locations (e.g., along seam 219) to form an elongated panel structure. Alternatively, the outer section 250 can be formed of a single panel structure and the first seam 219 is eliminated. In the illustrated embodiment shown in FIGS. 3-5 and similar to the construction of the inner section 210, the outer section 250 of the crib liner 200 includes a first panel 260 and a second panel 270 that are divided along the first seam 219 or the like.

As shown in FIGS. 3-5, the crib liner 200 can be thought of as having an X-shape with the seam 219 representing the connection between the legs of the X.

The dimensions of the outer section 250 can be the same or different than the dimensions of the inner section 210. For example, the length of the outer section 250 can be greater than the inner section 210 to permit the outer section 250 be folded around the crib and into intimate engagement with the inner section 210 as described herein.

The first and second panels 260, 270 can be uniform or they can be different from one another. In the illustrated embodiment, the first and second panels 260, 270 are at least substantially uniform and are generally square or rectangular shaped. However, it will be understood that the panels can be formed to have other shapes so long as they perform the intended function. For example, one or more of the panels of the crib liner 200 can have a decorative look, such as having a decorative shape.

It will therefore be appreciated that the first and second panels 260, 270 are defined (formed) as a result of the inclusion of the seam 219 and in fact, the outer section 250 is preferably formed as a single continuous elongated structure with no discernable panels prior to joining the inner section 210 with the outer section 250 along the first seam 219.

Each panel 260, 270 is defined by a main body 275 and trim 277 or the like can extend about a boundary of the outer section 250 such that the trim 277 surrounds the main body 275. It will be appreciated that the trim 277 can be formed of a material that is different than the material that forms the main body 275. In the illustrated embodiment, the trim 277 can be in the form of a pair of horizontal strips of material that extend along top and bottom edges of the main body 275 and can include a pair of vertical strips of material that along to end edges of the main body 275.

In accordance with the present invention, the outer section 250 can and preferably is formed of a material that is different than the enhanced breathable material that forms the inner section 210. For example, the outer section 250 can be formed of a non-mesh type material.

Figure 7:
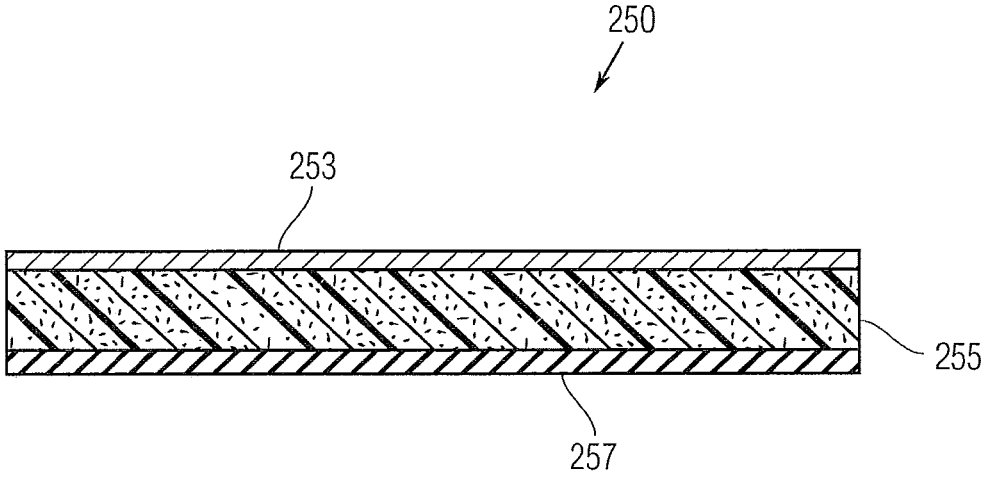
FIG. 7 is a cross-sectional view of a layered structure for use as one section of one exemplary crib liner according to the present invention.

It will be appreciated that the outer section 250 can be a single layer structure or it can be a multi-layer structure. For ease of simplicity, the outer section 250 illustrated in FIGS. 3-5 is formed of a single layer of material; however, as described herein and as shown in the cross-sectional view of FIG. 7, the outer section 250 can be a multi-layer structure. In FIG. 7, the outer section 250 includes a first layer 253, a second layer 255 and a third layer 257. The first and third layers 253, 257 are exposed layers, while the second layer 255 is an intermediate layer between the other layers 253, 257. The first layer 253 represents an inner face of the outer section 250 in that the first layer 253 faces the crib 100 and thus faces the child within the crib 100. Conversely, the third layer 257 represents an outer face of the outer section 250 in that the third layer 257 faces away from the crib 100.

It will also be understood that the second layer 255 can be eliminated leaving a two layer 253, 257 structure that can be attached along its peripheral edges as by using trim 277 or the like.

In one embodiment, the first layer 253 and third layer 257 are formed of the same material and can be formed of a natural or synthetic material or even a blend thereof. However, in another embodiment, the first layer 253 and third layer 257 are formed of different materials. For example, suitable materials for forming one or more of the first layer 253 and the third layer 257 include but are not limited to the following: natural or synthetic non-woven materials (or a blend thereof); natural or synthetic woven materials (or a blend thereof); knitted materials, formed materials (e.g., extruded materials (e.g., plastics/polymers), etc. Suitable natural materials include cotton and suitable synthetic materials include polyester and a suitable blend can be in the form of a blend of cotton and polyester. However, other materials, such as bamboo based materials and other synthetic materials can equally be used.

The second layer 255 can be in the form of padding or cushioning and therefore, can be formed of any number of different materials that serve this purpose. The second layer 255 can be formed of a natural material or synthetic material or a blend thereof. For example, the second layer 255 can be formed of spun polyester fibers or it can be formed of a foam material or other conventional padding material. In addition, the second layer 255 can be an air chamber or a bladder member, such as an inflatable air bladder that provide form and support and/or cushioning to the second layer 255.

As shown in FIG. 3, the inner and outer sections 210, 250 each of which can be in the form of a single elongated structure having opposing ends and a top edge and a bottom edge and are attached to one another at one or more locations using conventional techniques, such as by sewing along seam 219 or by some other means by which the two sections 210, 250 are attached to one another. For example, one or more fasteners can be used to attaching the sections 210, 250 together. It will also be understood that the inner and second sections 210, 250 do not have to be centrally attached as along seam 219 but instead can be attached to one another at one or more other locations, such as at the ends thereof (thereby allowing elimination of the permanent attachment point 219). When seam 219 is employed, it represents a type of permanent attachment between the inner section 210 and the outer section 250.

The crib liner 200 includes means for attaching the liner 200 to the crib and more specifically, includes means for attaching both the inner section 210 to the crib 100 and the outer section 250 to the crib 100. For example, the inner section 210 has a first end 211 and an opposing second end 213. Similarly, the outer section 250 has a first end 251 and an opposing second end 253. The first end 211 of the inner section 210 includes a first fastening element 300 and the second end 213 includes a second fastening element 310. Similarly, the first end 251 of the outer section 250 includes a third fastening element 320 and the second end 253 includes a fourth fastening element 330.

It will also be understood that more than one fastening element can be included at each of the ends 211, 213, 251, 253. For example, at each of ends 211, 213, 251, 253, a pair of fastening elements can be provided such as one being located at or proximate the top edge thereof and the other being located at or proximate the bottom edge thereof. In additional, each individual fastening element 300, 310, 320, 330 can be formed of several parts that mate together.

In accordance with one aspect of the present invention and as shown in FIGS. 3-5 and described in detail below, the first and second fastening elements 300, 310 are intended to attach the inner section 210 to the frame of the crib 100 (e.g., along a side rail), while the third and fourth fastening elements 320, 330 are intended to attach the outer section 250 to the first section 210 and further attach the crib liner 200 to the crib 100.

Alternatively, the first and third fastening elements 300, 320 can be complementary to one another and configured to intimately mate together for securing the first section 210 to the outer section 250 at one end of the crib liner 200. Similarly, the second and fourth fastening elements 310, 330 can be complementary to one another and configured to intimately mate together for securing the first section 210 to the outer section 250 at another end of the crib liner 200. In this embodiment, the inner section 210 is not attached to itself as shown in FIGS. 3-5 but instead is only directly attached to the outer section 250. For example, the fastening elements 300, 310, 320, 330 can be strips of hook and loop material and each end of the liner is attached by mating the complementary hook and loop material that is associated with the inner and outer sections 210, 250.

It will be appreciated that the fastening elements 300, 310, 320, 330 can be the same structures or they can be different from one another. Various fastening apparatus can be used to attach the inner section 210 and outer section 250 to a portion of the crib 100. For example, various types of fastening apparatus may include hook and loop closures (e.g., Velcro), snaps, buttons/buttonholes, ties, straps, buckles, zippers, magnets, etc. In the exemplary embodiment of FIGS. 3-5, the first and second fastening elements 300, 310 are in the form of buttons or snaps and the third and fourth fastening elements 320, 330 are in the form of hook and loop closures. However, the first and second fastening elements 300, 310 can be in the form of hook and loop closures or any other suitable fastener.

As a result, although hook and loop fasteners are preferable in some products, any other closure or fastener apparatus suitable for attaching crib liners or other crib accessories to the crib 100 can be used.

FIG. 12 shows yet another embodiment of a crib liner 285 that is similar to the liner 200 but is formed a single continuous structure. The liner 285 has a first end 287 and an opposing second end 289. The liner 285 also includes the inner section 210 and the outer section 250 (as described hereinbefore); however, in this embodiment, these sections 210, 250 are adjacent one another and joined or are integral to one another to form a single elongated continuous panel. The first section 210 has the properties discussed herein in that it is formed of a mesh material and the outer section 250 has the properties discussed herein in that it is formed of a different material, such as a non-mesh material. At the first end 287, a first fastening element 291 is provided and at the second end 289, a second fastening element 293 is provided. The fastening elements 291, 293 are complementary to one another and configured to mate together for attaching the liner to the crib 100. The fastening elements 291, 293 can be any of the fastening elements described herein.

To attach the liner 285 to the crib 100, the inner section 210 is positioned along the interior of at least one portion (e.g., a side rail) of the crib 100 and then the first end 287 is fed through the crib frame (e.g., between two vertical supports) to the exterior thereof and the outer section 250 is then run along the exterior of the at least one portion of the crib 100. The two ends 287, 289 are brought together and the fastening elements 291, 293 mate together about the crib frame (e.g. about a vertical support), thereby securely attaching the liner 285 to the crib 100. As in the previous embodiment, the inner section 210 formed of mesh is located within the interior, while the outer section 250 formed of a non-mesh material is located along the crib exterior. Intermediate fastening elements, similar to those described herein, can be used to attach the inner section 210 to the outer section 250 at select locations.

Figure 13:
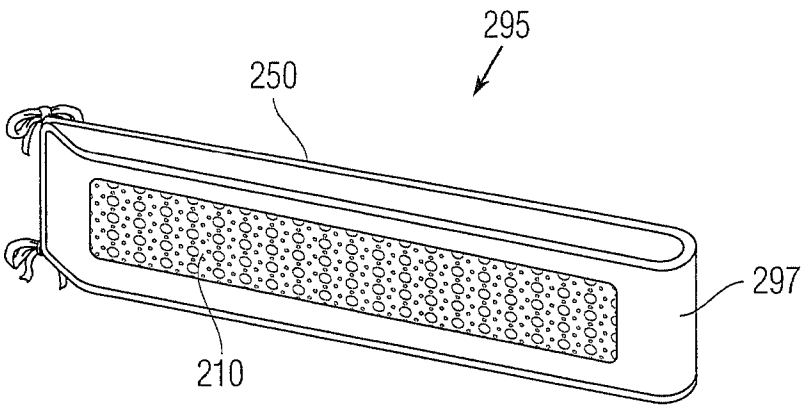
FIG. 13 is a perspective view of a crib liner similar to the one of FIG. 12 in a folded position showing an inner section.
Figure 14:
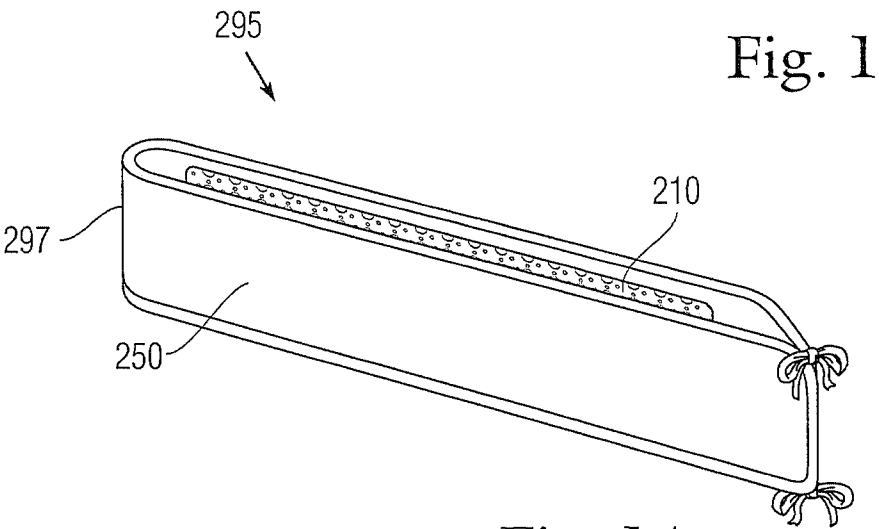
FIG. 14 is a perspective view of the crib liner of FIG. 13 in the folded position showing the outer section.

FIGS. 13 and 14 show a liner 295 that can be identical to liner 285 or similar thereto. In the embodiment of FIGS. 13 and 14, the liner can have an enlarged trim around a periphery of the first section 210. However, in one embodiment, the majority of the first section 210 is formed of mesh material. An intermediate portion 297 of the liner 295 represents a fold portion that extends about a support element to which the liner 295 is attached. The outer section 250 is preferably formed of a non-mesh material to provide as in the other embodiments, a crib liner that has a more conventionally looking outer section 250 (which can include a decorative surface—e.g., the outer surface of the outer section 250).

The embodiment of FIGS. 13 and 14 show fastening elements in the form of ties; however, as discussed herein, the fastening elements can be any number of different fastening elements as described herein.

As shown, when attached to the crib 100, the liner 295 is folded about the intermediate portion 297 and is attached only at the free ends of the liner 295. In other words, the liner 295 is folded on top of itself and its free ends are joined using fasteners 299. The fasteners 299 shown in FIGS. 13 and 14 are ties; however, any of the fastening elements described herein can be used.

When four separate crib liners 200 are used, the length of each "side rail" crib liner 200 is sized for allowing attachment to the crib 100 such that the crib liner 200 extends along at least a substantial length of the side rail of crib 100 and the length of each "headboard and footboard" crib liner 200 is sized for allowing attachment to the crib 100 such that the crib liner extends along at least a substantial length of the headboard and footboard. For example, the crib liner 200 can be wrapped about the side support elements of the side rail or about the corner posts of the crib frame and fastened thereto using the fastening elements 300, 310, 320, 330, as is further described below. In addition, the crib liner 200 can be wrapped about the side support elements of the headboard or footboard or about the corner posts of the crib frame and fastened thereto using the fastening elements 300, 310, 320, 330, as is further described below.

FIG. 2 shows another aspect of the present invention in that one or more sections of the crib liner 200 can include a grip element 400 that has non-skid material properties and is designed to restrict the free movement of the crib liner 200 about the crib support element to which the crib liner 200 is attached. In FIG. 2, the fastening element 310 is shown at the second end of the inner section 210 and is in the form of a pair of snaps or button. Between the two parts of the fastening element 310 that form the pair, one or more grip element 400 can be provided. In the illustrated embodiment, there is a single grip element 400 in the form of an elongated non-skid grip strip that extends along a length of the inner section 210 (i.e., it is horizontally oriented). The grip element 400 is disposed between the two parts of the fastening element 310 such that when the second end of the inner section 210 is wrapped about one or more support elements (vertical support elements), the grip element 400 is placed into intimate contact with the support elements. The non-skid surface of the grip element 400 thus restricts the free movement of the inner section 210 relative to the support element(s) to which it is attached.

It will be appreciated that the grip element 400 can also be oriented vertically and is not limited to being provided along the trim portion of the inner section 210. Thus, the grip element 400 can be disposed along the body portion (mesh portion) of the inner section 210.

Any number of different materials can be used to form the grip element 400 so long as they provide a non-skid surface. In other words, the grip element 400 has an exposed friction surface. For example, the grip element 400 can be formed of rubber or a synthetic material, such as a silicon material, having the desired properties.

FIGS. 3-5 show one exemplary method for attaching the crib liner 200 to at least one portion of the crib frame. For example, the FIGS. 3-5 show the crib liner 200 being attached to vertical supports (either supports 116 or supports 136). When the crib liner 200 includes integral seam 219 the crib liner 200 is first placed between two vertical supports 116, 136 and then the panels 220, 230 are disposed along the interior of the crib along the interior surfaces of the crib frame (vertical supports) and then the panels 260, 270 are disposed along the exterior of the crib along the exterior surfaces of the crib frame (vertical supports).

Next, as shown in FIGS. 3 and 4, the inner section 210 of the crib liner 200 is attached to the crib frame by wrapping the ends 211, 213 about one or more of the vertical supports 116, 136 and attaching the inner section 210 to itself. For example, the first end 211 is laterally pulled and then folded outwardly and wrapped about one or more vertical supports 116, 136 and then attached to itself by means of the first fastening element 300. When the first fastening element 300 is a snap or button, the two parts thereof are intimately mated. When the first fastening element 300 is a hook and loop structure, the hook and loop material is intimately mated together. Similarly, the second end 213 is laterally pulled and folded outwardly and wrapped about one or more vertical supports 116, 136 and then attached to itself by means of the second fastening element 310. When the second fastening element 310 is a snap or button, the two parts thereof are intimately mated. When the second fastening element 310 is a hook and loop structure, the hook and loop material is intimately mated together. This results in the inner section 210 being attached to the crib 100.

As shown in FIGS. 4-5, the outer section 250 is then attached to the inner section 210 by laterally pulling the end 251 and wrapping it around the already attached inner section 210 and then effectuating an attachment between the ends 251, 253 of the outer section 250 to the inner section 210 so as to produce a secure attachment of the crib liner 200 to the crib 100.

Since the outer section 250 is attached to the inner section 210, the third and fourth fastening elements 320, 330 are constructed to intimately mate with and attach to the inner section 210. For example, either the inner surface of the inner section 210 can include a complementary element that mates with the corresponding third and fourth fastening elements 320, 330 to accomplish attachment between the outer section 250 and the inner section 210. A piece of hook and loop material can be provided along the inner surface of the first section to mate with the corresponding third or fourth fastening element 320, 330.

Optionally, intermediate fastening elements 350 can be provided at select points along the length of the inner section 210 and outer section 250. The intermediate fastening elements 350 can have the same fastening structures as the other fastening elements 300-330 or they can be different. For example, in the illustrated embodiment, two intermediate fastening elements 350 can be provided for attaching select regions or points of the outer section 250 to the inner section 210 between adjacent vertical supports 116, 136. While, FIGS. 3-5 show the fastening elements 350 as being snaps or buttons, the fastening elements 350 can be in the form of strips of hook and loop material. The intermediate fastening elements 350 provide additional points of attachment between the inner section 210 and the outer section 250.

It will be understood that the crib liner 200 and the other liners described herein are designed so that it utilizes the natural construction of the crib 100 to provide air flow passages to provide improved breathability. More specifically, the inner section 210 that is formed of mesh material is along the interior of the crib and therefore, in contact with the infant, while the outer section 250 is disposed along the exterior of the crib away from direct contact with the infant. The frame of the crib is disposed between the inner section 210 and the outer section 250 and the spaces between the vertical supports 116, 136 provide air flow passages that are in direct contact with the mesh material of the inner section. Air can thus flow into the spaces between the vertical supports 116, 136 and through the mesh material of the inner section 210.

At the same time, the outer section 250 provides a decorative surface that has different material properties and thus a different feel and is spaced from direct contact with the child.

Figure 9:
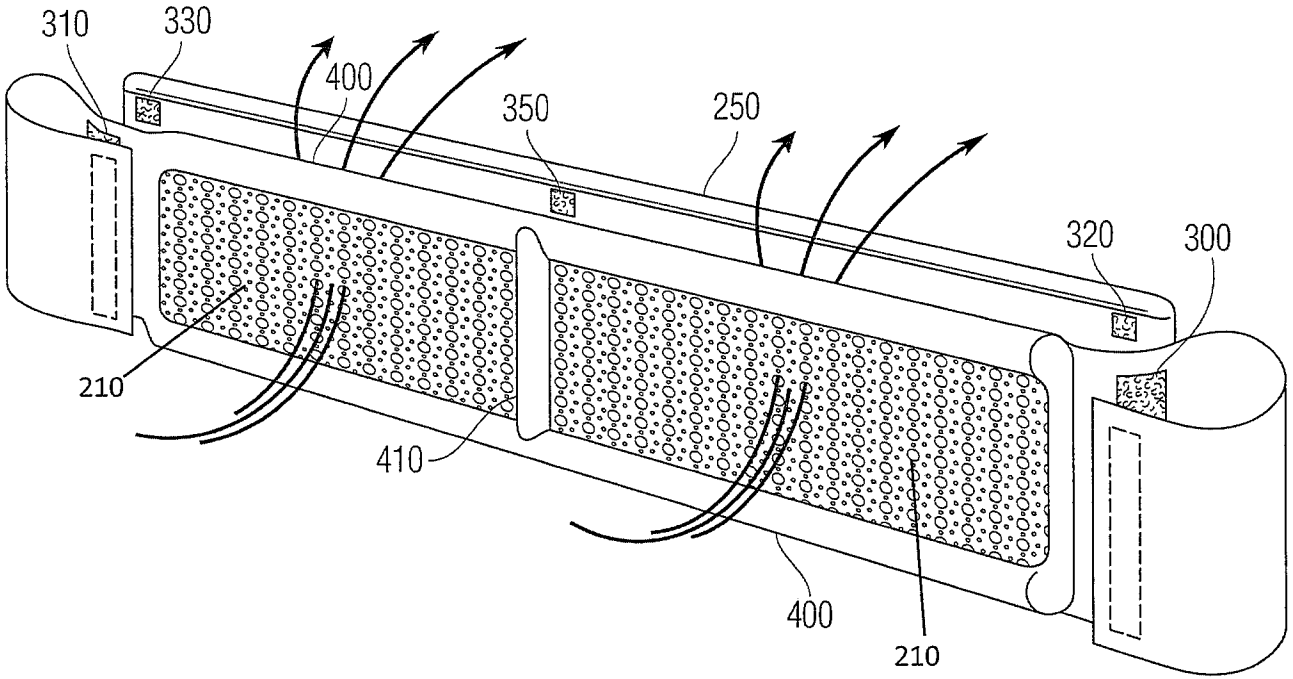
FIG. 9 is a perspective view of a crib liner according to another exemplary embodiment and including a spacer element.
Figure 10:
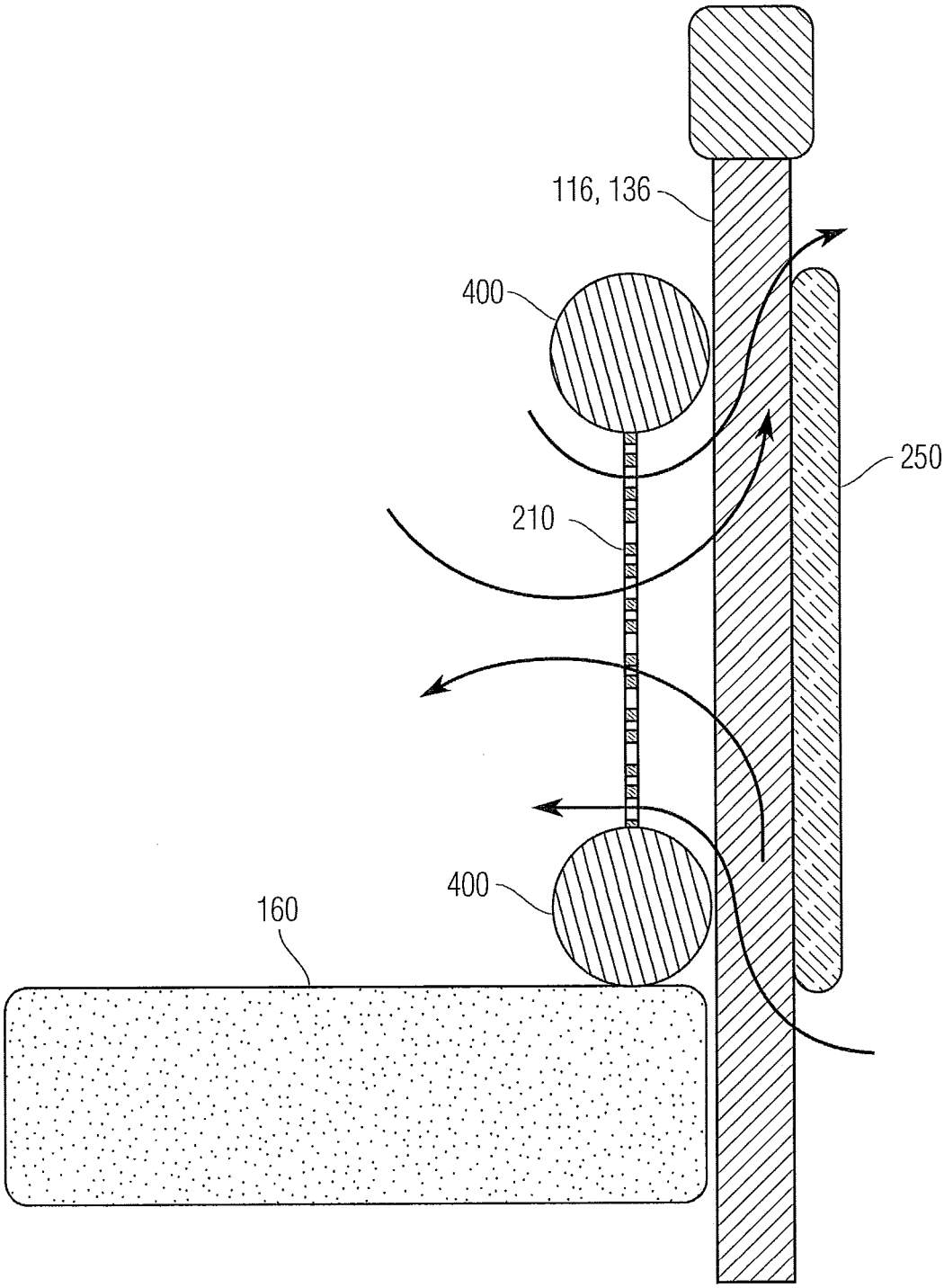
FIG. 10 is a cross-sectional view showing the crib liner of FIG. 9 installed on a crib frame.

Now referring to FIGS. 9-10 and according to yet another embodiment of the present invention, the crib liner 200 can include a means for spacing at least a portion of the crib liner 200 from the frame of the crib 100. In particular, the inner section 210 can include at least one spacer element 400 that is disposed along the inner section 210 such that the spacer element 400 is coupled to the body portion of the inner section 210 and is configured to seat against the frame of the crib 100 such that the inner section 210 is spaced therefrom.

FIG. 10 shows the inner section 210 including one spacer element 400 along the top edge of the inner section 210 and another spacer element 400 along the bottom edge for spacing the inner section 210 from the vertical supports 116, 136. The outer section 250 is shown in more intimate contact with the exterior surfaces of the vertical supports 116, 136. As illustrated with arrows, improved air flow is provided since the mesh material of the inner section 210 is spaced from the vertical supports 116, 136 (and thus not in direct contact therewith). Unlike in conventional designs even those formed entirely of mesh material, the present invention provides a space/air gap between the exterior face of the first section 210 and the inner surfaces of the vertical supports 116, 136.

For example, the spacer element 400 can be formed of an open cell foam or a closed cell foam and can be an elongated structure that extends along a portion of the inner section 210. Other materials can be used so long as the materials have sufficient rigidity to space the body of the inner section 210 from the frame of the crib 100 (e.g., the vertical support elements of the crib) when the inner section 210 is disposed along the inner face of the frame.

The spacer element 400 is coupled to the inner section 210 using conventional techniques. For example, the spacer element 400 can be bonded to the material of the inner section 210 using an adhesive, etc. Alternatively, the spacer element 400 can be attached using a mechanical attachment or a fastening element. In addition, the spacer element 400 can be at least partially disposed within one or more pockets or loops that are formed as part of the inner section 210. The pockets and loops capture the spacer element 400 but permit removal thereof if necessary.

It will be understood that the spacer element 400 is not limited to being a tubular shaped structure and can have any number of different shapes, including but not limited to square shaped, rectangular shaped, etc. In addition, the spacer element 400 can be an at least partially hollow structure or it can be a solid structure or can be an air-filled structure.

The spacer element 400 can be formed as a single integral structure as shown in FIG. 9 or it can be formed of a plurality of parts that are coupled together or spaced apart along the inner section 210. In this case, each part is separately attached/coupled to the inner section 210.

The spacer element 400 can include an intermediate spacer element 410. In the illustrated embodiment, the intermediate spacer element 410 is vertically oriented between two horizontal spacer elements 400.

FIG. 9 shows the inner section 210 having hook and loop type fastener elements 300, 310 and the outer section 250 likewise includes hook and loop type fastening elements 320, 330.

It will be appreciated that at least one spacer element 400 can be disposed longitudinally along a length of the inner section 210 and/or at least one spacer element 400 can be disposed vertically along a height of the inner section 210. For example, the spacer element 400 can be formed along at least one of a top edge of the inner section 210 and a bottom edge of the inner section 210 and/or the spacer element 400 can be formed along one or more ends of the inner section 210.

It will be appreciated that the spacer element 400 can be a longitudinal spaced element that is spaced from the top and bottom edges of the inner section 210 and in particular, at least one spacer element 400 can be centrally located between the top and bottom edges. Similarly, the vertical spaced element can be spaced from the ends of the inner section 210 (e.g., the vertical spaced element can be centrally located).

The spacer element 400 can and preferably has a thickness that is greater than a thickness of the inner section 210 so as to space the inner section 210 from the crib frame. For example, the thickness of the spacer element 400 can be at least twice as great as the thickness of the inner section 210 or it can be at least three times as great as the thickness of the inner section 210. The thickness and/or position of the spacer element 400 is selected such that the spacer element 400 spaces the inner section 210 away from crib frame.

The spacer element 400 is formed of a different material compared to the inner section (including the trim of the inner section which may be a non-mesh material).

While the drawings show the spacer element 400 disposed along and coupled to the top and bottom edges of the inner section 210, it will be understood that the spacer element 400 can be disposed along the inner surface (face) of the inner section 210 (e.g. along a lower section of the inner surface near or at the bottom edge).

It will be understood that a crib liner that include a spacer element 400 (such as liner of FIG. 9) can be at least partially disposed against a solid wall of the crib 100. For example, some cribs include one solid side wall and others include a solid headboard, and the crib liner with spacer element 400 can be disposed thereagainst so as to space the liner from the solid wall.

Figure 11:
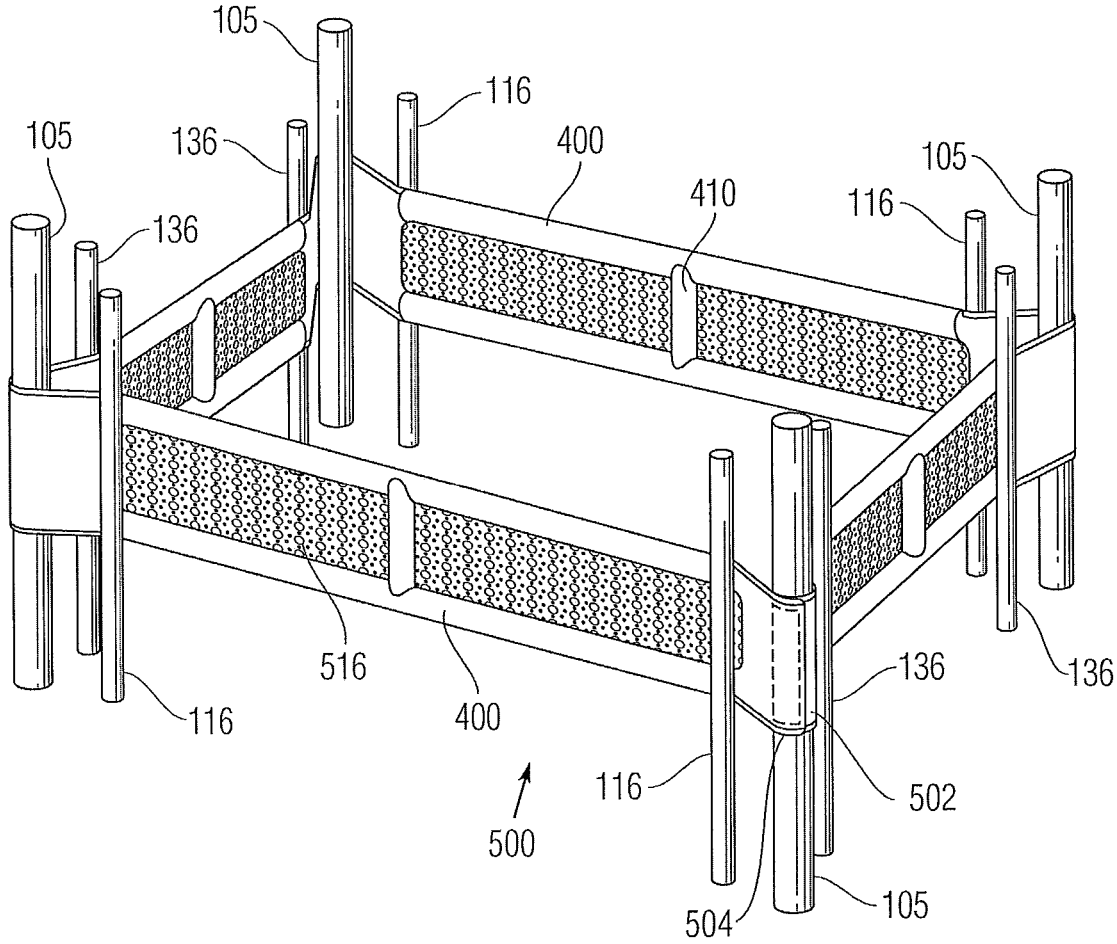
FIG. 11 is a perspective view of a crib liner according to another exemplary embodiment and shown installed on a crib frame.

FIG. 11 shows another embodiment in which a crib liner 500 according to another embodiment is shown. In this embodiment, the crib liner 500 is formed as a single continuous structure that has two free ends 502, 504. The ends 502, 504 represent and define the attachment point. In this product, the crib liner 500 is only formed of the inner panel section 510 that is formed of a mesh material (as described earlier with reference to inner section 210). At least some portions of the inner panel section 510 include spacer elements 400. The inner panel section 510 can be formed so that the mesh material makes up a majority of the inner panel section 510.

FIG. 11 shows the attachment of the continuous crib liner 500 in which the liner 500 is substantially disposed along the interior of the crib but wraps around the corner posts 105 (on exterior surfaces thereof) as by being disposed between the vertical support 116, 136 and corner post 105. The crib liner 500 attaches along one location at the ends 502, 504. Any number of fastening elements can be used to attach the ends 502, 504, such as those described herein (e.g., hook and loop material).

As with the embodiment shown in FIGS. 9-10, the product of FIG. 11 utilizes spacer elements 400 to space the inner panel section 510 from the crib frame (vertical supports 116, 136) and therefore, improved air flow passages are provided as discussed with reference to FIGS. 9-10.

Figure 15:
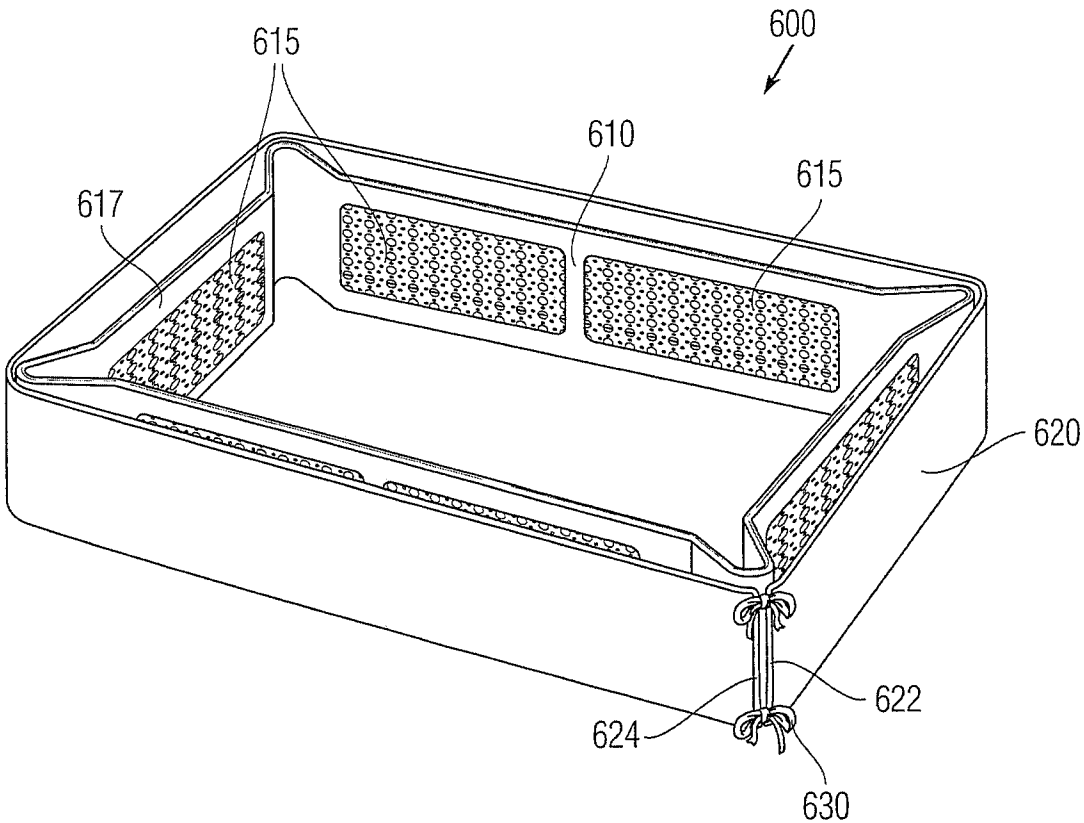
FIG. 15 is a perspective view of a crib liner according to one embodiment.
Figure 16:
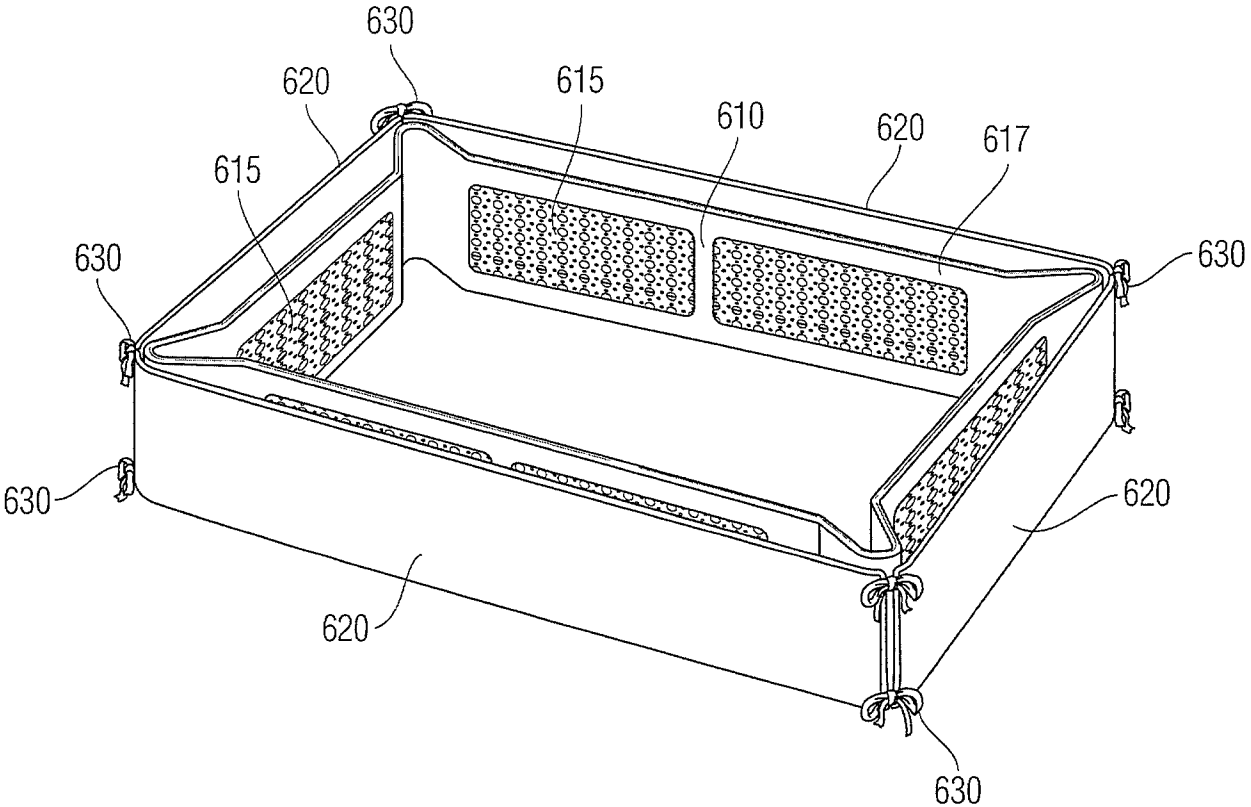
FIG. 16 is a perspective view of a crib liner according to another embodiment.

FIGS. 15 and 16 provide additional embodiments that are similar to the embodiments described herein. In particular, FIG. 15 shows a crib liner 600 that includes a single continuous inner panel structure 610 that is similar to the inner section 210 shown in FIGS. 3-5. The inner panel structure 610 is disposed along the interior of the crib frame and is formed of mesh material. In the illustrated embodiment, the inner panel structure 610 includes mesh panels 615 with trim 617 surrounding the peripheries of the mesh panels 615. The trim 617 can have different dimensions so as to be more pronounced as in FIGS. 13-14 or less pronounced as in the other figures and can be formed of any number of different materials, including materials described herein as being suitable for use in forming the outer section 250.

The inner panel structure 610 is attached at or proximate its free ends using fasteners of a type described herein. It will further be appreciated that the inner panel structure 610 can be formed of more than one separate panel structure in which case the ends of the separate panel structures are attached to the crib with fastening elements.

The liner 600 also includes an outer panel structure 620 that is disposed along the exterior of the crib frame. Similar to the inner panel structure 610, the outer panel structure 620 is a single continuous panel structure that is similar to the outer section 250 shown in FIGS. 3-5. The outer panel structure 620 is disposed along the exterior of the crib frame and is formed of a material that is different than the mesh-material of the first panel structure 610 (e.g. non-mesh material). The outer panel structure 620 can also include a mesh section as well. In the illustrated embodiment, the outer panel structure 620 is attached at or proximate its free ends 622, 624 using fasteners 630 of a type described herein. In the illustrated embodiment, the fasteners 630 are ties; however, other fasteners can be used. The outer panel structure 620 can thus be attached to one corner post of the crib frame.

The outer panel structure 620 can include decorative indicia, such as a decorative print along an outer surface thereof.

Both the inner panel structure 610 and outer panel structure 620 are attached and maintained in place by interweaving the panels between various support elements that form the crib frame.

FIG. 16 is similar to FIG. 15 with the difference being that the outer panel structure 620 is not formed of a single continuous panel but instead is formed of a plurality of panel structures. FIG. 16 shows four separate outer panel structures 620; however, two or more panel structure 620 can be used and be attached the crib frame. Each panel structure 620 is attached to the crib and/or the inner panel structure 610 at its two opposing free ends by means of fastening elements 630. Once again, the illustrated fastening elements 630 are ties; however, other fastening elements can be used.

The present invention provides an attractive decorative product while providing enhanced safety and breathability along the section of the product that is facing and in contact with the infant. It will be appreciated that the decorative surface is not limited to being the exterior face (surface) of the outer section 250 and other faces (surfaces) of the product can be a decorative surface. For example, the inner face of the inner section 210 can be a decorative surface and include indicia, etc. In addition, the outer face of the inner section 210 can be a decorative surface. It will therefore be understand that in any of the liners disclosed herein, a decorative surface can be provided on either or both of the inner section 210 and outer section 250 (any surfaces thereof).

It will also be understood that the crib liner 200 shown in FIGS. 1-5 can extend along more than one portion of the crib frame and in particular, one crib liner can extend along one side rail 110, 120 and along at least a portion of one of the headboard 140 and the footboard 130.

As used herein, the term "substantial length" of at least one of the side rails, headboard and footboard is a length that is at least ⅔ of the length of the respective crib frame structure. However, while in some embodiments, the liner extends a substantial length of a respective portion of the crib, the liners of the present invention can be attached to a crib such that they extend less than a substantial length of the respective portion of the crib (e.g., extending half the length; extending less than half the length, etc.).

Figure 17:
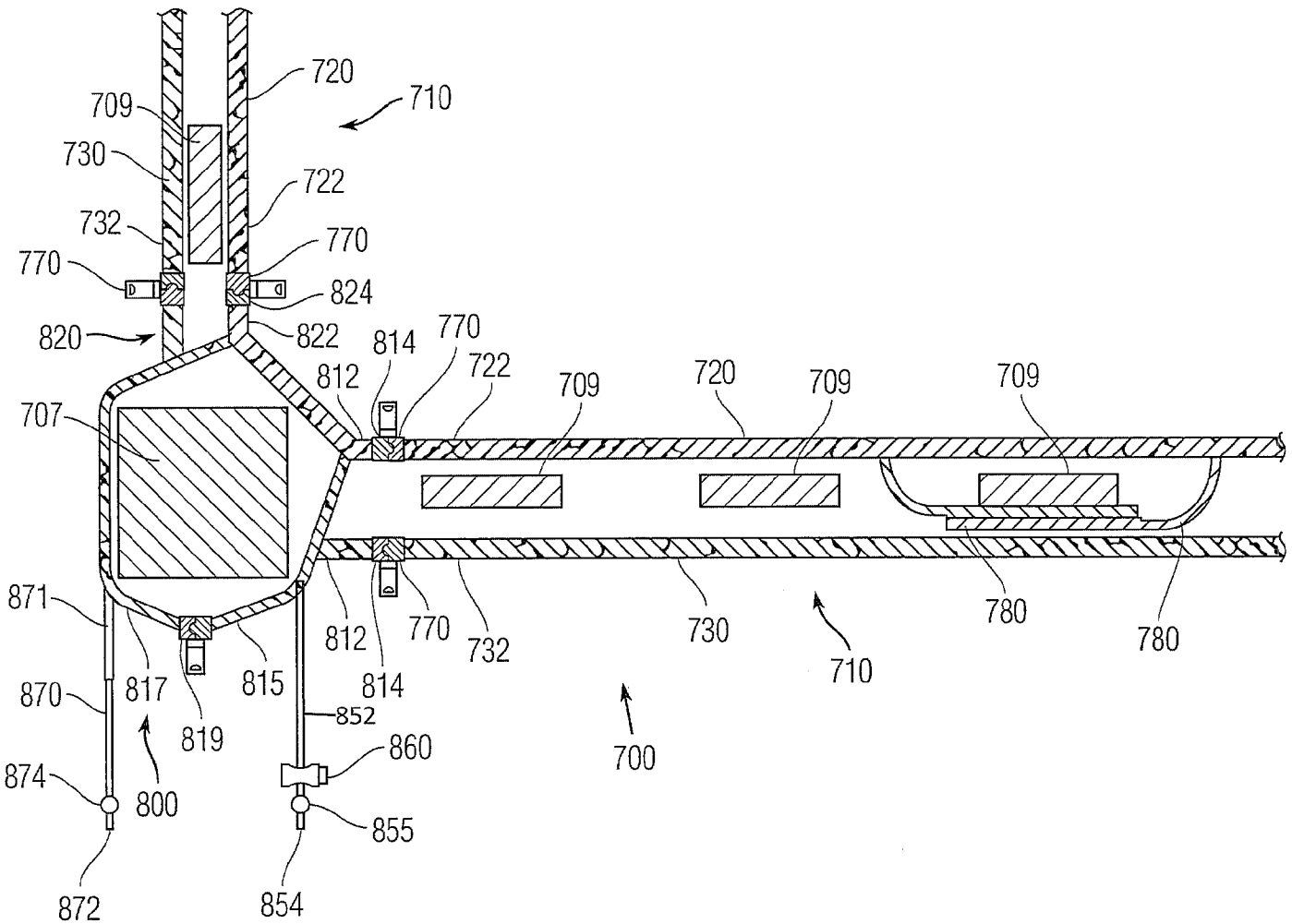
FIG. 17 is a cross-section top plan view of a crib liner according to another embodiment showing a first step for attaching the liner to a corner post.

FIG. 17 is a cross-sectional top view of one corner of a conventional crib showing a crib liner 700 according to another embodiment attached thereto. The crib is of a traditional type that has four corner posts 707 and cribs slats 709 extend along at least one side or one end of the crib. The crib slats 709 are spaced apart from another and extend between horizontal frame members. Between the crib slats 709, there are open air spaces as discussed previously. In the illustrated embodiment, the crib is shown to have crib slats 709 along one side and one end of the crib with the corner post 707 being in the corner. In accordance with the present invention, the crib liner 700 can include a number of separate pieces that are joined together about the corner post 707 in a detachable manner and in a manner that advantageously permits the attachment of the liner 700 to the corner post 707 to be adjusted to account for different sized and different shaped cribs, thereby allowing an optimal attachment to be realized. In today's market, there are a vast number of different crib designs and more particularly, there are different sized cribs and different shaped cribs. Some cribs have a much larger corner post 707 construction compared to others (or vice versa) and this poses difficulties for conventional liner products that are provided in one size. The result can be liners that are attached in a less than ideal manner with some liners sagging, etc. The liner 700 of the present invention overcomes these deficiencies and is designed to be used with the vast number of cribs on the market and is designed to provide optimal fit due to the adjustment mechanism/feature that is incorporated into the liner 700.

In the illustrated embodiment, the liner 700 includes a plurality of panels 710 that are attached to at least some of the sides and ends of the crib. For purpose of illustration only, the crib is discussed as having two short sides (e.g., ends) and two long sides that have crib slats 709 that extend along each side. However, it will be appreciated that a number of crib products on the market do not include crib slats 709 along four sides but instead can includes crib slats along only two or three of the sides. As will be appreciated herein, the liner 700 is designed to be installed in these types of cribs that have crib slats 709 on only two or three sides.

The illustrated liner 700 is constructed such that each panel 710 that extends along one side is formed of two sections that can be entirely separate from one another or can be joined to one another at select locations. For example, the two sections can be in the form of an inner panel section 720 that extends along inner surfaces of the crib slats 709 and an outer panel section 730 that extends along outer surfaces of the crib slats 709. The inner panel section 720 thus faces the infant that is in the crib, while the outer panel section 730 faces away from the infant. The inner panel section 720 includes two opposing ends 722 and the outer panel section 730 includes two opposing ends 732. The inner panel section 720 and the outer panel section 730 are preferably sized to have a length to allow the ends 722, 732 of the two sections 720, 730, respectively, to travel to the corner posts 707 that lie along and at the ends of the side.

In accordance with the present invention, each of the inner panel section 720 and the outer panel section 730 is constructed at least partially of a mesh material, including all types of mesh materials discussed herein. More specifically, each panel section 720, 730 includes a mesh section 750 that is formed of the mesh material and a non-mesh section 760. The mesh section 750 is located in areas which may potentially block breathing of child (e.g., through the mouth and nose of a child) and the non-mesh section 760 is located at a position that is not exposed to the breathing child during normal use of the crib. The mesh section 750 is a lower section of the panel and the non-mesh section 760 is an upper section of the panel. The relative heights of the sections 750, 760 are selected such that during normal use of the crib, the child's nose and mouth are position adjacent the mesh section 750. The non-mesh section 760 is thus located above the child's nose and mouth when the child lies on the mattress in the crib. In one embodiment, the mesh section 750 occupies less than a majority of the surface area of the panel. For example, the mesh section 750 can occupy between about 20% to about 40% of the panel surface area. However, in other embodiments, the mesh section 750 can occupy a majority of the panel's surface area (e.g., between about 50% and 65%. In addition, the mesh section 750 can occupy a surface area between 40% and 50%. It will also be appreciated that the mesh section 750 does not have to extend completely to the bottom of the panel but instead some decorative material (e.g., a small band) can be formed thereat. The heights of the inner panel section 720 and the outer panel section 730 are preferably identical or similar to one another.

At each of the ends 722 of the inner panel section 720 and the ends 732 of the outer panel section 730 includes a fastener 770. For example, various types of fasteners can include hook and loop closures (e.g., Velcro), snaps, buttons/buttonholes, ties, straps, buckles, zippers, magnets, etc. In the exemplary embodiment of FIG. 17, the fastener 770 comprises one mating part of a zipper.

Along the length of either one or both of the inner panel section 720 and outer panel section 730, one or more secondary fasteners 780 can be provided and constructed to provide a further attachment between the panel section and the crib and in particular, the crib slats 709. The secondary fasteners 780 can be of the same types mentioned above relative to the fasteners 770. For example, the illustrated secondary fasteners 780 are in the form of straps that include hook and loop material that mates together so as to attach the panel to and around one crib slat 709.

In accordance with the present invention, the liner 700 includes a corner post attachment member 800 that securely attaches the panels 720, 730 to the corner post 707 in an adjustable manner. The corner post attachment member 800 is preferably a unitary structure that includes a first means 810 for attaching the member 800 to the panels 720, 730 that extend along one side of the crib and a second means 820 for attaching the member 800 to the panels 720, 730 that extend along another side of the crib that terminates at the same corner post 707.

The member 800 is in the form of a body that extends about the corner post 707 and is substantially continuous in structure and the first means 810 is in the form a pair of flaps 812 that extends outwardly from the body and each includes a fastener 814 formed at the end thereof. The fasteners 814 are complementary to the fasteners 770 disposed at the ends of the inner panel section 720 and outer panel section 730 along one side of the crib. The fasteners 814 can have any form discussed herein with respect to suitable types of fasteners used in any embodiments of the present invention. In the illustrated embodiment, the fasteners 814 are in the form of a mating part of the zipper that is completed by fastener 770 which is thus in the form of the other mating part of the zipper. Thus, each set of fastener 770 and fastener 814 mates and zips together to form an attached seam therebetween. In this manner one portion of the body of the member 800 is attached to panels 720, 730 that extend along one side of the crib.

Similarly, the second means 820 is in the form of a pair of second flaps 822 that extends outwardly from the body and each includes a fastener 824 formed at an end thereof. The fasteners 824 are complementary to the fasteners 770 disposed at the ends of the inner panel section 720 and outer panel section 730 along the other side of the crib. The fasteners 824 can have any form discussed herein with respect to suitable types of fasteners used in any embodiments of the present invention. In the illustrated embodiment, the fasteners 824 are in the form of a mating part of the zipper that is completed by fastener 770 which is thus in the form of the other mating part of the zipper. Thus, each set of fasteners 770 and fasteners 824 mate and zip together to form an attached seam therebetween. In this manner one portion of the body of the member 800 is attached to panels 720, 730 that extend along the other side of the crib.

As shown in the figure, the pair of flaps 812 and pair of flaps 822 are located about 90 degrees apart from one another since the panels 720, 730 of one side intersect the corner post 707 generally perpendicular to the panels 720, 730 of the other side.

When all of the fasteners associated with the corner post attachment member 800 and the panels 720, 730 are mated together, the panels of two sides of the crib are thus joined to one another about the corner post.

To complete the attachment of the member 800 to the corner post 707, the body of the device 800 is formed of two sections 815, 817 that are selectively joined one another to form a continuous body and thereby completely enclose the post 707 within the member 800. The section 815 includes the first pair of flaps 812 and the section 817 includes the second pair of flaps 814. At free edges of the sections 815, 817, fasteners 819 are provided and the fasteners 819 can be of the same types mentioned above relative to the fasteners 770. For example, the illustrated fasteners 819 are in the form of two mating parts of a zipper. When the fasteners 819 are attached, the body of the member 800 forms a continuous structure that extends about the corner post 707 with the fasteners 819 disposed along an accessible face of the corner post 707.

By incorporating multiple fasteners into the member 800, the member 800 is both easily attached to the panels 720, 730 and also is easily attached to the corner post 707. As mentioned above, the member 800 also includes a means for adjusting 850 the fit of the member 800 about the corner post 707 and in particular, the means 850 includes a cinching type device which allows the member 800 to be tightened about the corner post 707 to effectuate a more optimal attachment. It will be appreciated that other means besides a cinching mechanism can be used to provide a member 800 that has a variable dimension to fit the corner post. For example, an elastic member, such as an elongated elastic band or the like can be incorporated into a section of the member 800 to cause a more optimal fit to be realized due the elastic properties. The elastic thus draws the member 800 into a snug fit with the corner post.

The means 850 includes a cinch cord 852 that is attached at one end to an inner portion of the member 800 and can be fed through a channel formed in the device to allow attachment to the inner portion of the member 800. The cinch cord 852 extends outwardly from the member 800 and has an opposite free end 854 that can be grasped by the user to tighten the device 800 about the corner post 707. The free end 854 can include a stop 855 in the form of a knot that prevents the free end 854 from freely traveling within the channel of the member 800. Along the cinch cord 852 a friction device with a release 860 can be provided. Once the cinch cord 852 is pulled and the member 800 tightens about the corner post 707 to effectuate a secure attachment, the friction device 860 is moved along the cinch cord in a direction away from the free end to effectively, lock the cinch cord in place. To move the friction device 860 along the cinch cord 852, the release (which can be a button or the like) is pressed and then it is released to lock the friction device 860 in place.

The cinch cord 852 extends from the flap 815 of the body of the proximate the first means for attaching the body to the panels 720, 730 that extend along one side of the crib.

The means 850 also includes a tie 870 that extends from the flap 817 of the body and is attached to the body at one end and has a free end 872. More specifically, the tie 870 is attached to an extended flap section 871 that extends from the main flap 817 of the member 800 proximate the fastener 819. The length of the extended flap 871 is such that when it is folded back over the body of the member 800, the extended flap 871 covers the fasteners 819.

The elements 870 are not limited to being ties but also can be in the form of hook and loop strips and mate with the cinch cord 852 to provide a clean fastened product.

At the free end 872, a stop 874, such as a knot, can be formed. The cinch cord 852 and tie 870 are thus on opposite sides of the fasteners 819 that complete the body. The tie 870 is fixed to the extended flap 871 of the member 800, while the cinch cord 852 travels within an inner channel formed within the member 800 and is fixed to the body at a location that is further from the point where the cinch cord 852 intersects the body and further from the point where the tie 870 intersects the body. This arrangement is due to the fact that the cinch cord 852 is designed to pull or gather an inner section of the body of the member 800 and draw it together so as to effectuate a cinching action. The cinching action causes the corner post attachment member 800 to tighten therearound resulting in a more optimal, secure fit. As previously mentioned the cinching mechanism that is incorporated into the corner post design allows the device of the present invention to be used with any number of different types of cribs. In other words, the corner post 707 design varies from crib to crib and since the corner posts represent the principle means for attaching the liner to the crib, the liner of the present invention overcomes the deficiencies of the conventional designs and provides a liner that can be used with a substantially more number of cribs currently be marketed due to the adjustment means incorporated into the corner post attachment.

Figure 18:
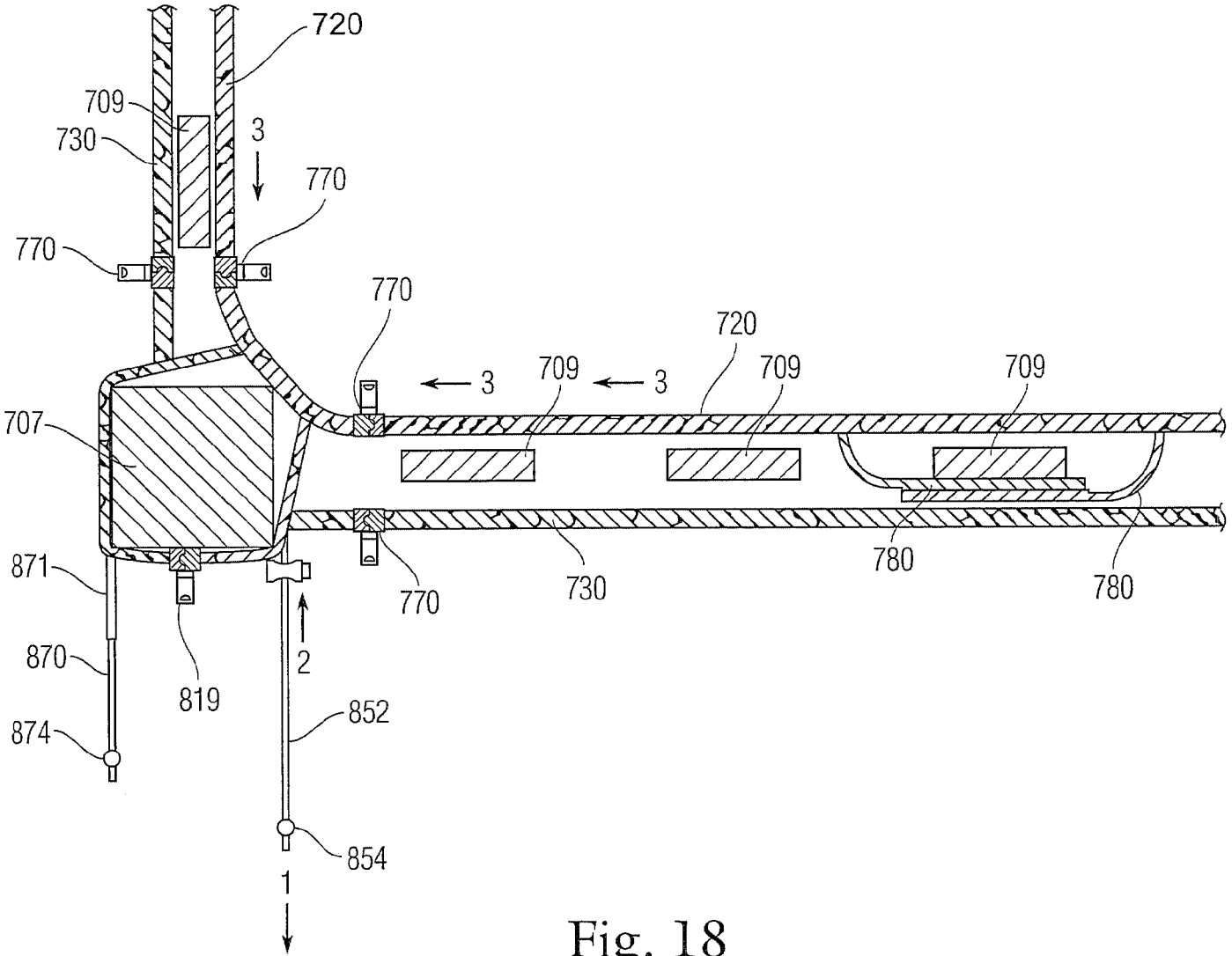
FIG. 18 is a cross-section top plan view of a crib liner of FIG. 17 showing a second step for attaching the liner to a corner post.
Figure 19:
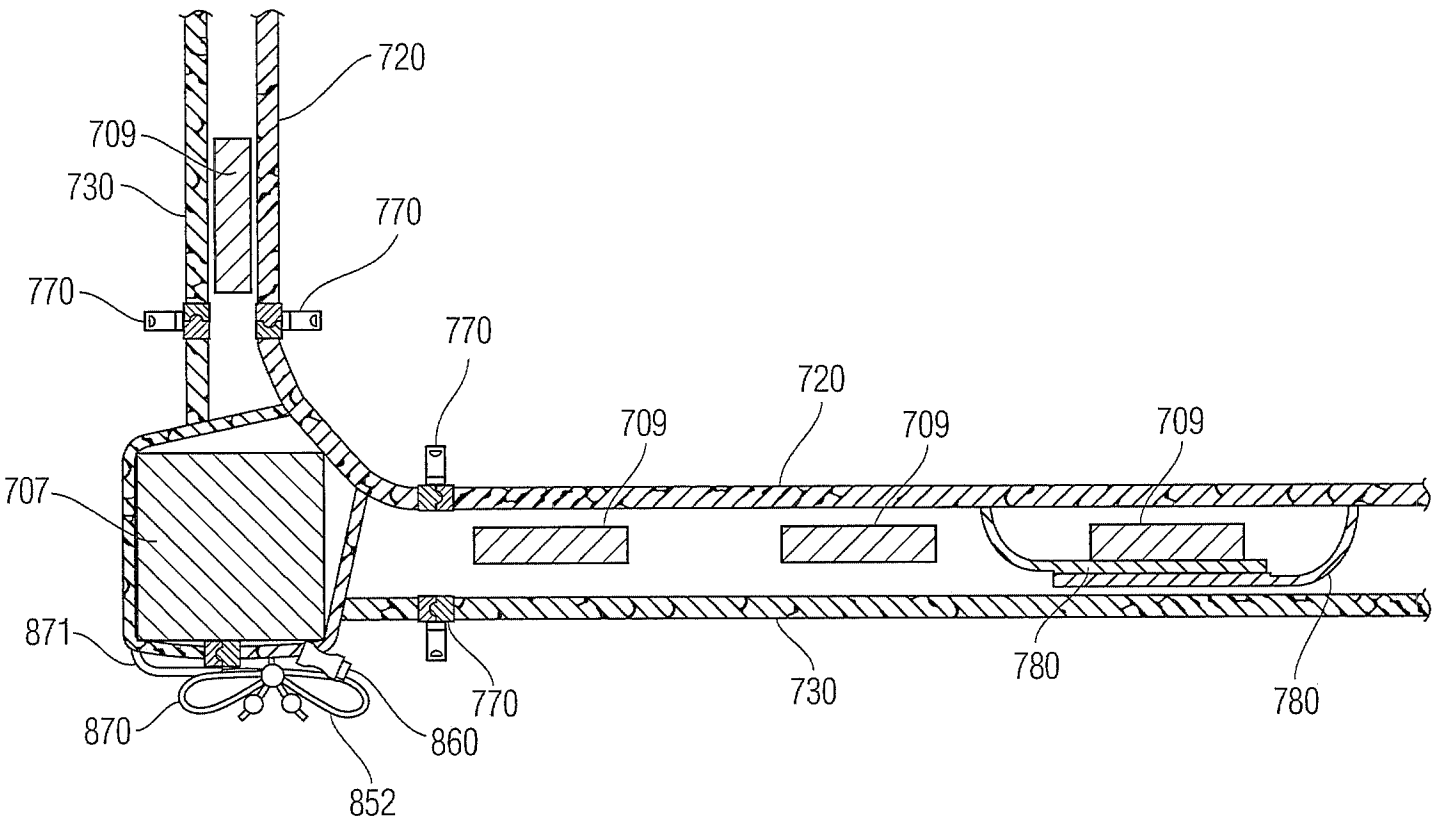
FIG. 19 is a cross-section top plan view of a crib liner of FIG. 17 showing a third step for attaching the liner to a corner post.

FIGS. 17-19 show the steps involved in attaching the liner to the crib. In FIG. 18, the cinch cord 852 is pulled in a direction (1) away from the crib so as to draw the body (main flaps 815, 817) of the corner post attachment member 800 into a tighter engagement with the corner post 707. This action reduces the slack in the corner post attachment member 800. In other words, the cinching action of the corner post attachment member 800 causes the body of the member 800 to be drawn in towards the corner post resulting in a more tighter, snug fit. FIG. 18 also shows the friction device 860 being moved in a direction (2) toward the corner post 707 to act as a stop and hold the extended length of the cinch cord 852. This likely requires release of the release button of the friction device 860. The movement of the friction device 860 locks the cinch cord 852 in the desired location. It will be appreciated that when slack is pulled from the two different sections of the corner post attachment member 800 (as shown by arrows (3) in the figure), the diameter of the corner post attachment member 800 is reduced. The result pulls slack from the inner panel 720 that lies along one side and the outer panel 730 that lies along an adjacent side of the crib and meets the inner panel from the one side in the same corner.

FIG. 19 shows the tying of the tie 870 and the cinch cord 852 and folding over the flap 871 which provides a pleasing appearance and covers the functional fasteners 819. The result is a pleasing, polished product.

It will be appreciated that each member 800 preferably includes a pair of cinch cords 852 and a pair of ties 870. For example, for each member 800, one cinch cord 852 and one tie 870 can be provided at an upper end of the corner post attachment member 800 and one cinch cord 852 and one tie 870 can be provided at a lower end of the corner post attachment member 800. In this manner, both the upper section and the lower section of the member 800 are securely attached about the corner post 707.

FIGS. 20-23 are perspective views of a liner 900 that is similar to the liner 700. As a result, like elements are numbered alike. One difference between the liner 900 and the liner 700 is that the liner 900 does not include two sections for each panel that extends along one side of the crib. Instead, each panel is only formed of one panel section, such as inner panel 720 as shown. Ends 722 of the inner panel 720 include fasteners 770 as discussed herein. For purpose of illustration, the fasteners 770 are in the form of zippers; however, as discussed herein, any number of different fasteners can be used.

The corner post attachment member 801 is also modified for attachment only to a single panel section 720 along each side of the crib. The member 801 thus still includes first means 810 for attaching the member 801 to the panel 720 that extends along one side of the crib and second means 820 for attaching the member 801 to the panel 720 that extends along another side of the crib that terminates at the same corner post 707. The first means can be in the form of a first flap 812 that extend outwardly from the body (section 815) and the second means can be in the form of a second flap 822 that extends outwardly from the body (section 817). The fasteners 814 at ends of the flaps 812, 822 are used to attach the member 801 to the respective panels 720 that extend along the inner surfaces/faces of the crib sides. In the illustrated embodiment, the fasteners 814 are zippers; however, they can be any of the fasteners disclosed herein.

The member 801 includes the sections 815, 817 that include free ends that each includes fastener 819. The sections 815, 817 can thus be opened relative to one another to allow reception of the corner post 707 within the member 800.

It will also be appreciated that while the corner post attachment member 801 can be a separate member relative to the panels 720, it can be an integral component in that that there is a single elongated, continuous panel that has a plurality of corner post attachment members 801 formed therealong at spaced intervals. For a four sided crib, there will be four members 801 to attach the continuous panel to four corner posts of the crib. The corner post attachment members 801 can thus include integral sections 815, 817 that extend outwardly from the rest of the panel structure and create a pocket that receives the corner post when the member 801 is in an open position as discussed herein. In the open position, the integral sections 815, 817 are not attached to one another and the fasteners 819 are used to attach the sections 815, 817 to form a continuous pocket structure that surrounds the corner post 707. The section 815 still includes at least one and preferably a pair of cinch cords 852 (upper and lower cinch cords) that are constructed as described hereinbefore. The section 815 includes at least one and preferably a pair of ties 870 that mates with the cinch cords 852 as described herein.

Figure 20:
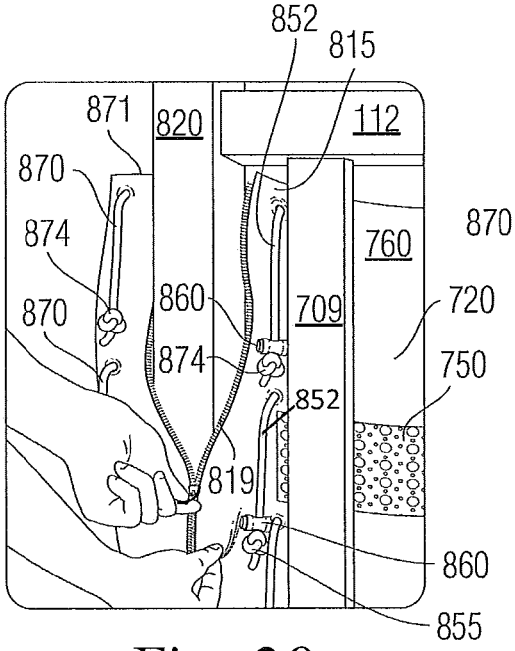
FIG. 20 is a side perspective view of a crib liner according to another embodiment showing a first step for attaching the liner to a corner post.
Figure 21:
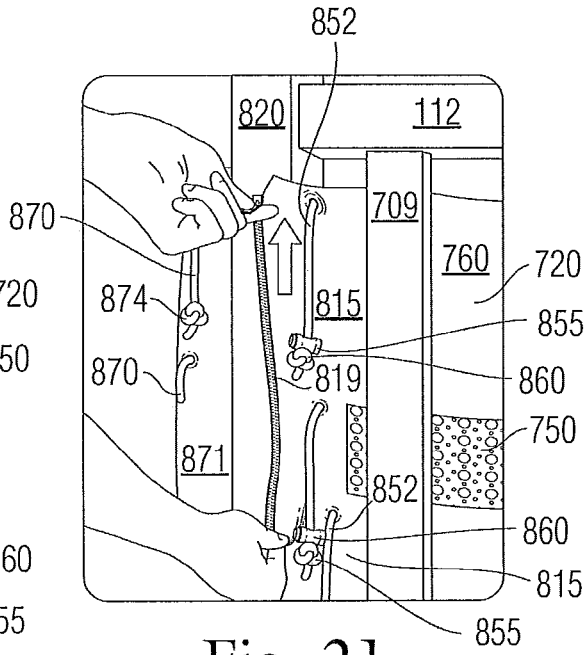
FIG. 21 is a side perspective view of a crib liner according to another embodiment showing a second step for attaching the liner to a corner post.
Figure 22:
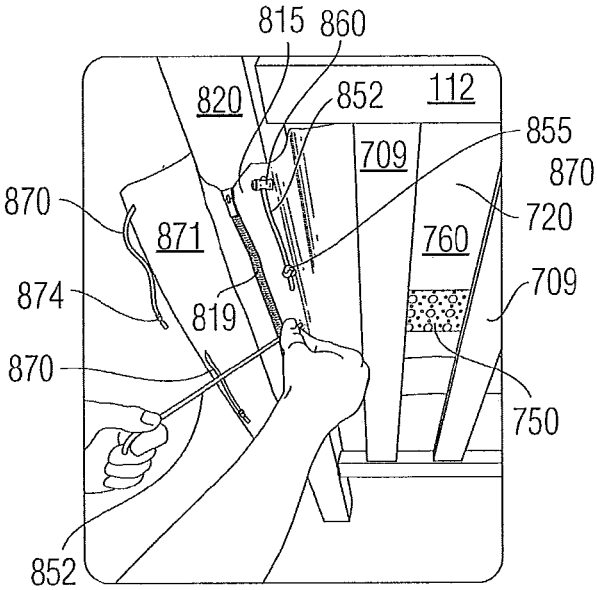
FIG. 22 is a side perspective view of a crib liner according to another embodiment showing a third step for attaching the liner to a corner post.
Figure 23:
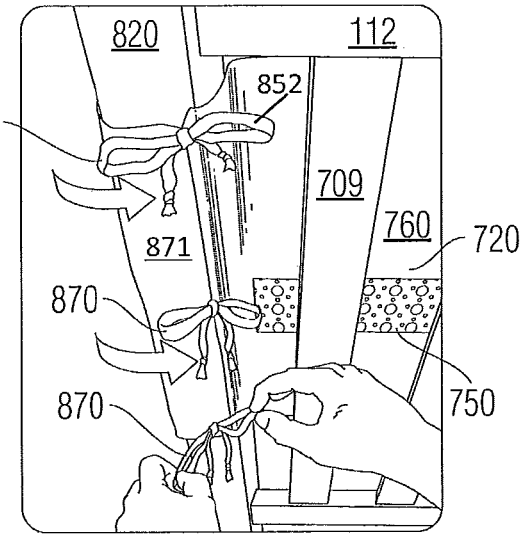
FIG. 23 is a side perspective view of a crib liner according to another embodiment showing a fourth step for attaching the liner to a corner post.

FIG. 20 shows the sections 815, 817 being wrapped around the crib corner post 707 and the fasteners 819 are mated together to securely attach the member 801 to the corner post 707. FIG. 21 shows further the securing of the member 801 by means of the fasteners 819, in this case a zipper. As in the previous embodiment, FIG. 22 shows pulling on the cinch cord 852 and pushing the friction device 860 to remove excess slack from the corner post attachment member 801. FIG. 23 shows the extended flap being folded over to conceal the fasteners 819 and the ties 870 and the cinch cords 852 are tied to one another.

It will thus be appreciated that in this embodiment, the single panel product is fed along the inner faces/surface of the crib frame and the liner is attached primarily by attachment to the corner posts and secondarily, panel to crib attachment is possible as described herein.

The product can be provided so that it is a continuous uninterrupted liner that is disposed in place along the inner faces of the crib slats along the sides of the crib by simply lowering the liner into the crib above the mattress and then generally placing the corresponding side panels 720 of the liner next to respective sides of the crib. In some designs, the liner may or may not fit between the mattress and the sides, and it may extend below the top of the mattress, extending down to the platform the mattress rests on. The liner is then attached to the crib by attaching the corner post attachment members to the respective corner posts and then using the adjustment (cinching) mechanism described herein for removing excess slack in the corners. This is contrast to conventional liners that are not continuous structures but have at least two free ends that are attached.

In another embodiment, the liner can have two free ends that are attached with fasteners to form a completely attached structure. The corner post attachment members are formed integrally along the liner's body and are spaced at set intervals that are intended to position each corner post attachment member proximate to one corner post of the crib for attachment thereto.

It will be apparent from FIGS. 20-23 that the panels 720, 730 shown in FIGS. 17-19 can include a mesh portion and a non-mesh portion as described herein. In addition the panels shown in FIGS. 17-23 can be formed, at least in part, of mesh in some embodiments.

In addition, while FIGS. 20-23 show the placement of one panel along the inner surface of the crib side, an alternative liner is one in which the panel is disposed along the outer surfaces of the crib. Thus, the one panel can extend along the outer surfaces of the crib support elements 709 (without a panel section along the inner surfaces of the crib support elements 709). The member(s) 800 still serves to attach the panel to the corner post(s). Thus, one or more panels extend along the outside of the crib (and preferably includes a mesh section and non-mesh section) and the member 800 receives the corner post within the pocket defined therein and then is attached as discussed herein. The member 800 is disposed along the inner surfaces of the corner post 707 since it surrounds the corner post (while the panels are limited to the outside of the crib in this one embodiment). This arrangement is also true for multiple panels that are used on one crib (i.e., four panels with four members 800).

In yet another embodiment, the liner 700 can attach to a mattress panel section that the mattress rests on. This provides further means for securely attaching the liner 700 to the crib. The means for releasably attaching the liner to the crib can be any of the fastener types described herein. The liner can be permanently sewn to the mattress panel section or can be releasably attached. The mattress panel section can be formed of any number of different materials including different materials relative to the panel (since the infant does not come into contact with this portion).

The advantages of the present invention will be readily apparent in that excess slack is removed in the liner due to the adjustable corner portions of the liner and as a result, the present liners can be used on a vast number of crib designs. Conventional liners are much more rigid and unforgiving in their constructions and if an optimal fit did not result, the liner may sag due to the slack therein. This is less than an ideal fit.

The present invention thus broadly encompasses a corner post crib liner attachment mechanism that allows the liner to be securely and properly attached to a number of different crib designs without requiring the product to be modified or retrofitted. This is due to the integral cinching mechanism that causes the corner post attachment member to be drawn inward toward the corner post and then locked in place when a snug fit results between the corner post attachment member and the corner post.

FIGS. 24-30 illustrate a liner 1000 according to another embodiment. The liner 1000 can be in the form of a continuous liner structure that is constructed, as discussed below, to be disposed along the inside of the crib (i.e., the liner 1000 seats against the inner surfaces of the slats of the crib frame). When the liner 1000 has this construction, the liner 1000 can be removed from the product packaging and then inserted into the crib and placed in contact with the inner surface of the crib's frame. While not shown, the liner 1000 can be formed as an elongated structure that has two opposite ends that are joined together in one corner to form a continuous liner structure that is disposed along the inside of the crib (i.e., the liner 1000 seats against the inner surfaces of the slats of the crib frame).

Figure 24:
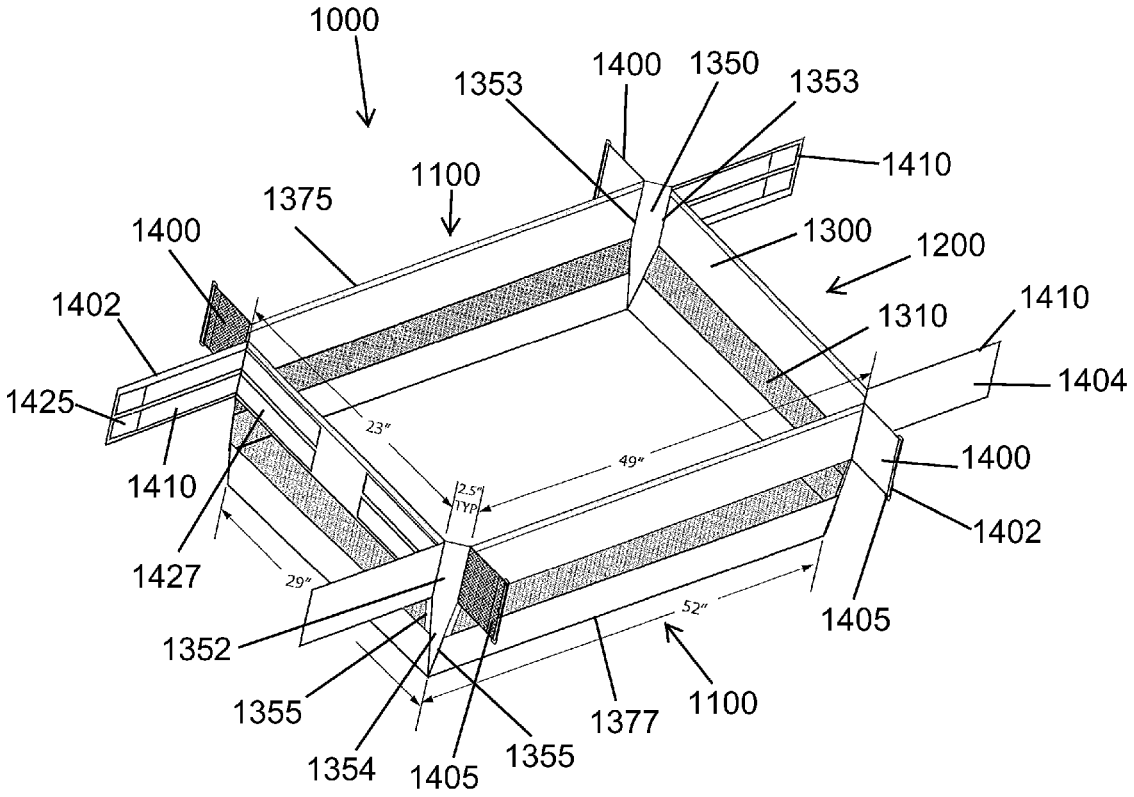
FIG. 24 is a top and side perspective of a crib liner according to one embodiment.

Despite having the above construction, the liner 1000 has a plurality of distinct integral sections that seat against different corresponding sections of the frame of the crib. More particularly, the liner 1000 has a pair of opposing side sections 1100 and a pair of opposing end sections 1200, with the end sections 1200 typically having shorter lengths compared to the lengths of the side sections 1100. However, the present invention also covers a liner that is formed of four sections that are substantially the same and are intended for placement along four corresponding sides of the crib (e.g., two side rail sections and two end rail sections, etc.) (in this case, the sections 1100, 1200 can be the same). When the two free ends of the liner 1000 are attached to one another, the liner 1000 has a generally rectangular shape as shown in FIG. 24. As mentioned above, in the assembled state shown in the figures, there are no free liner ends and to the user, the liner appears to be a continuous structure that includes different sections that are joined together along seams or the like.

In accordance with the present invention, each of the sections 1100, 1200 can be formed so as to include a mesh section and more particularly, each of the illustrated sections 1100, 1200 can be formed of an upper material portion 1300, a middle material portion 1310 and a bottom material portion 1320. The upper and lower portions 1300, 1320 can be formed of a non-mesh material such as a (cloth) fabric layer that can have a layer of padding incorporated therein. It will also be appreciated that any or all of the portions 1300, 1310, 1320 can have decorative indicia associated therewith.

As described herein with reference to other previous embodiments, the mesh section (e.g., the middle material portion 1310) can be formed of any number of different mesh materials that are commercially available. The mesh material readily allows airflow into and out of the crib when the liner 1000 is attached to the crib.

In accordance with one embodiment, the surface area of the middle portion 1310 is less than 66% of the total surface area of each panel and more particularly, the surface area of the middle portion 1310 can be less than 55%; less than 50%; less than 40%, etc. The portions 1310, 1320, 1330 are constructed such that the relative heights of each is such that the middle portion 1310 is positioned generally adjacent to the top surface of the crib mattress so as to allow airflow into and out of the crib. The lower portion 1320 can be disposed along and even below the side of the mattress.

For purposes of the present application, the sections 1100, 1200 can also be thought of as being a panel of the liner 1000. Each panel is intended to cover one side (end) of the crib. However, the panel can be formed of a plurality of sections that are joined together to form a continuous structure. The panel can also be thought of as being formed of several separate panel sections that are joined together (e.g., as by stitching).

A panel can also be thought of, in one embodiment, as being a structure that is disposed between two corner posts of the crib and as described herein, when the liner includes defined corner sections, one panel section is disposed between two corner sections.

In accordance with the present invention, the liner 1000 can be provided to have gusseted corner sections 1350. The gusseted corner sections 1350 are designed to be disposed in the corners of the crib when the liner 1000 is attached to the crib along the interior thereof. The gusseted corner sections 1350 are thus formed between adjacent sections 1100, 1200 of the liner 1000. It will be appreciated that in one embodiment, the gusseted corner sections 1350 thus serve as joining pieces that join together the sections (panels) 1100, 1200. The panels 1100, 1200 can thus be formed separate from the corner sections 1350 and then attached to the corner sections 1350 to form the continuous liner 1000. The panels 1100, 1200 and corner sections 1350 can be attached using conventional techniques, including stitching, etc.

As shown in FIGS. 24-26, the gusseted corner sections and the constructions of the sections (panels) 1100, 1200 cause each panel 1100, 1200 to have unequal lengths along the top and bottom edges thereof. In other words, the top edge of each panel 1100, 1200 (as measured between the corner sections 1350) is different than a length of the bottom edge of the panel 1100, 1200. In one embodiment, each panel 1100, 1200 has a trapezoidal shape in that a top edge 1375 of each panel has a length that is different (e.g., greater) than the corresponding bottom edge 1377 of the panel. For example, in the illustrated embodiment, the top edge of the section 1100 (side panel) has a length of about 49 inches, while the bottom edge has a length of about 52 inches; and similarly, the top edge of the section 1200 (end panel) has a length of about 23 inches, while the bottom edge has a length of about 29 inches. It will be understood that these dimensions are merely exemplary and not limiting. The difference in length between the top and bottom edges is due to the construction (shape) of the panel itself and the construction of the corner sections 1350.

As shown in FIG. 24, the gusseted section 1350 includes a top portion 1352 which is defined by a pair of sides (edges) 1353 that are substantially parallel to one another, while a bottom portion 1354 of the gusseted section 1350 has an inwardly tapered construction and is defined by a pair of inwardly tapered edges 1355 that meet at a point that is defined along the bottom edge of the panel.

As also shown in FIG. 24, the gusseted sections 1350 can be coupled to the adjacent panels (sections 1100, 1200) such that the gusseted sections 1350 are formed at an angle to the adjacent panels which are generally located along planes that are generally perpendicular to one another.

As shown in FIG. 24, the section 1100, 1200 (panel) can be constructed such that the upper (top) portion 1300 has parallel ends that are perpendicular, while the middle and bottom portions 1310, 1320 have ends that are not parallel to the ends of the upper portion 1300. The ends of the middle and bottom portions 1310, 1320 can be axially aligned and can be parallel to one another. The ends of the middle and bottom portions 1310, 1320 of adjacent panels 1100, 1200 intersect one another at the bottom edge in one corner. This construction of the ends of the middle and bottom portions 1310, 1320 is complementary and mirrors the shape of the gusseted section 1350 which is attached between the ends of the adjacent panels 1100, 1200.

The trapezoidal shape of the liner 1000 as a result of the gusseted sections 1350 provides a number of advantages including but not limited to the fact that the construction allows for the standard size mattress to fit freely into the lower portion of the liner 1000 as a result of the bottom portion of (each panel of) the liner 1000 having a greater dimensions (length) compared to the top portion thereof. One reason for the top edge of the liner 1000 to be a smaller dimension is that to attach the liner 1000 to the crib, the user preferably pulls the slack for the configuration and makes the finished assembly taut.

In accordance with one embodiment, the corners of the liner 1000 have an attachment means for attaching the liner 1000 to the frame of the crib. The attachment means is in the form a first fastener element 1400 associated with one section 1100 and a second fastener element 1410 associated with the adjacent section 1200. The first and second fastener elements 1400, 1410 extend outwardly from the liner so as to allow the elements 1400, 1410 to be inserted through an opening (e.g., a slot) formed in the crib frame proximate the corner (e.g., corner post). The elements 1400, 1410 are thus wrapped around and secured to the corner post of the crib frame, thereby securely attaching the liner 1000 to the crib in a releasable manner.

Even when the top edge of the liner includes the lengths of the top edges of the corner sections and the bottom edge of the liner includes the lengths of the bottom edges of the corner sections, the top edge of the liner has an overall length that is different than a length of the bottom edge. For example, the overall length of the top edge can be less than the overall length of the bottom edge of the liner (e.g., trapezoidal shape).

In one embodiment, the fastener elements 1400, 1410 can be integral to the corner section 1350 in that the corner section 1350 can include the fastener elements 1400, 1410. In this embodiment, the corner section 1350 with fastener elements 1400, 1410 can be a separate integral part that is then attached to ends of the adjacent panels 1100, 1200 to form the continuous liner 1000. As set forth herein, the fastener elements 1400, 1410 can be separate from the corner section 1350 and can instead be attached to the adjacent panels 1100, 1200.

The first fastener element 1400 has a first length and the second fastener element 1410 has a second length such that when the liner 1000 is placed within the inside of the crib, the elements 1400, 1410 are of sufficient length to extend around the exterior of the corner post of the crib and engage one another as described herein. In particular, each of the fastener elements 1400, 1410 has a feature that allows the elements to mate and be pulled taut with respect to one another, thereby securely attaching the liner to the crib's frame.

The fastener elements 1400, 1410 when joined (mated) define a looped structure that surrounds the corner post of the crib and is adjustable along at least one dimension so as to attach the liner 1000 to the crib.

In the illustrated embodiment, the first element 1400 can be formed of a flexible material and is shorter in length than the second element 1410 and includes a slit 1405 formed at or near the distal end 1402 thereof. The slit 1405 can be integrally formed within the flexible material (natural or synthetic material) or can be defined between the distal end of the flexible material and another element (such as a buckle) that is attached to the distal end such that a small vertical slit is provided. The second element 1410 is likewise formed of a flexible material (of greater length than the first element 1400) and includes a first surface or face 1402 and an opposing second surface or face 1404. The first surface 1402 carries at least one fastener 1425 that is configured such that the second element 1410 can be securely attached to either itself or to a portion of the section (panel) 1200 by means of complementary fastener 1427 associated with the section (panel) 1200 (or when it is attached to itself, the fastener 1427 is part of the second element 1410). In other words, when a length of the second element 1410 is folded over and the fastener 1425 mates with the fastener 1427, the folded length is securely attached to another length of the second element 1410 or is attached to second panel 1200.

For example, the fastener 1425 can be in the form of an elongated strip of hook and loop material and the fastener 1427 can likewise be an elongated complementary strip of hook and loop material. As shown in FIG. 25, the fasteners 1425, 1427 can be a single elongated piece of hook and loop material that extends not only along the first surface 1402 of the element 1410 but along extends along a length of the exterior surface of the upper portion 1300 of the end section (panel) 1200. In this way, the second element 1410 can be folded into contact with the exterior surface of the upper portion 1300 and is attached thereto.

Alternatively, the fastener elements 1425, 1427 can be located on the same fastener element 1410 and thus, when folded over the free end of the fastener element 1410 can be attached to another section of the fastener element 1410. It will also be appreciated that the fastener element 1427 can be only located along the panel 1200 and does not extend onto the fastener element 1410 that extends outwardly from the liner 1000 (e.g., extends outwardly from the corner section 1350).

While the illustrated fastener 1425 is in the form of one or more elongated strips of hook and loop material, it will be appreciated that other fasteners 1425 can equally be used including but not limited to hooks, buttons, snaps, ties, or other types of mechanical fasteners. Thus, in one aspect of the present invention, the fastener elements 1400, 1410 are configured such that they form a looped structure that surrounds the corner post of the crib. The fastener elements 1400, 1410 are also configured such that at least one dimension (e.g., the circumference) of the looped structure can be varied by adjustment of at least one of the fastener elements 1400, 1410. In the illustrated buckle configuration, the circumference of the looped structure is reduced by continued pulling of the second fastener element 1410 though the first fastener element 1400. The second fastener element 1410 is continuously pulled until a taut looped structure is formed.

FIGS. 25 and 26 show the elements 1400, 1410.

Figure 27:
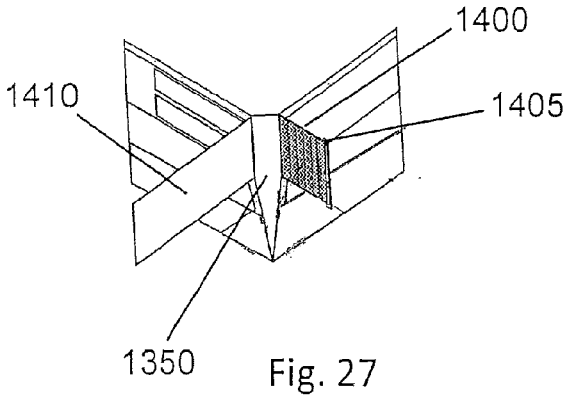
FIG. 27 is a perspective view of one corner of the crib liner showing a first step of fastening the crib liner to a corner post.
Figure 28:
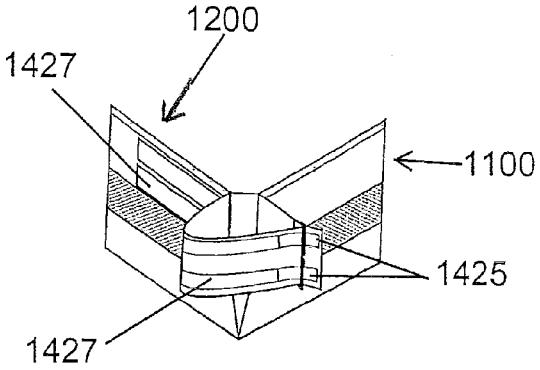
FIG. 28 is a perspective view of one corner of the crib liner showing a second step of fastening the crib liner to a corner post.
Figure 29:
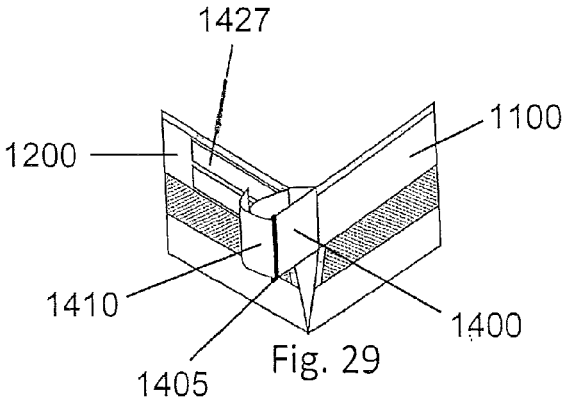
FIG. 29 is a perspective view of one corner of the crib liner showing a third step of fastening the crib liner to a corner post.
Figure 30:
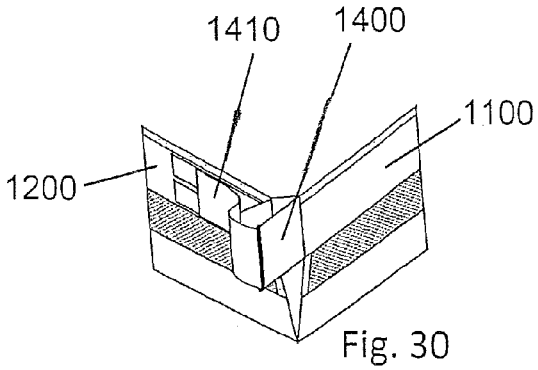
FIG. 30 is a perspective view of one corner of the crib liner showing a fourth step of fastening the crib liner to a corner post.
Figure 31:
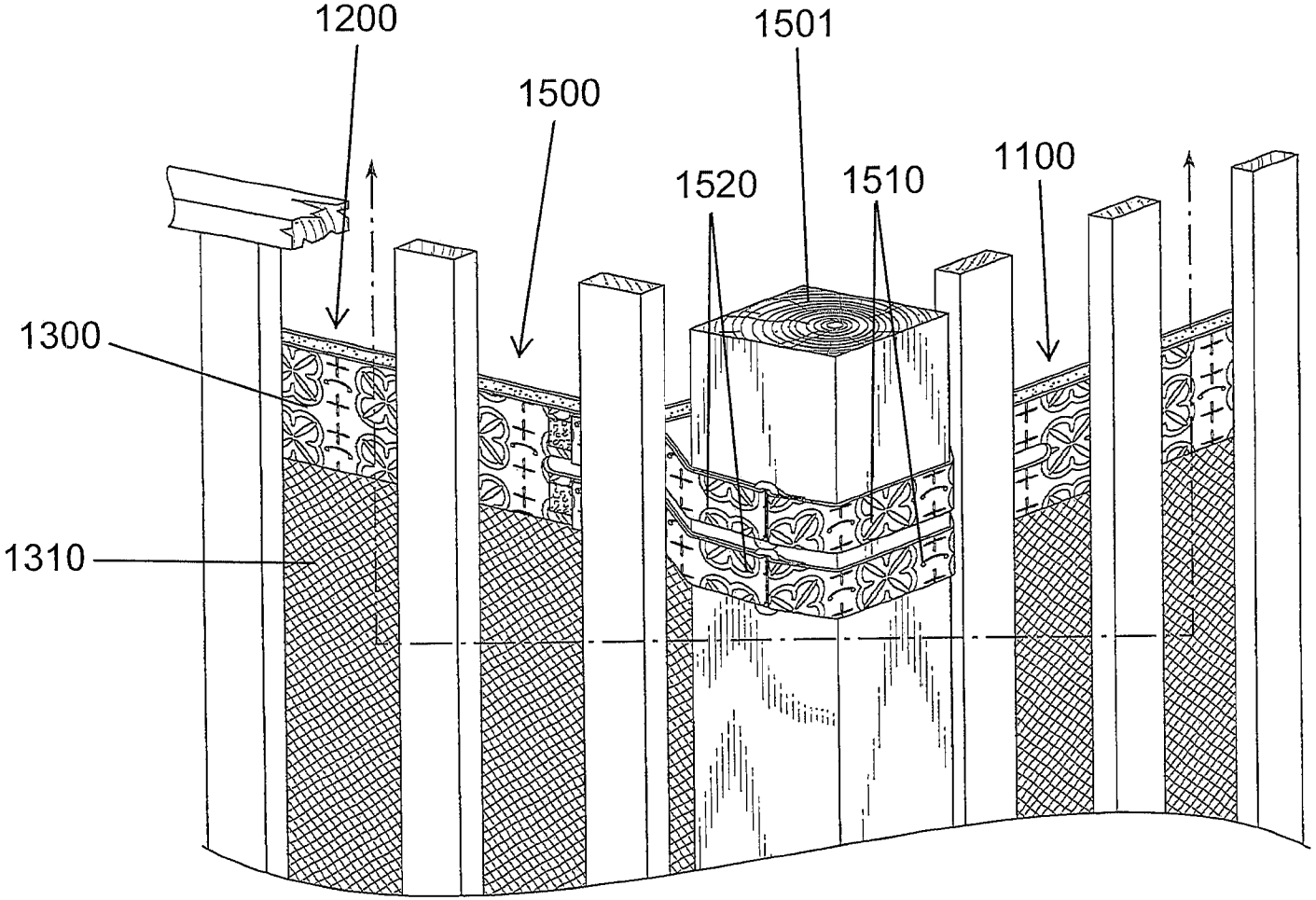
FIG. 31 is a perspective view of an exterior of one corner of a crib showing a crib liner according to the present invention attached thereto.
Figure 32:
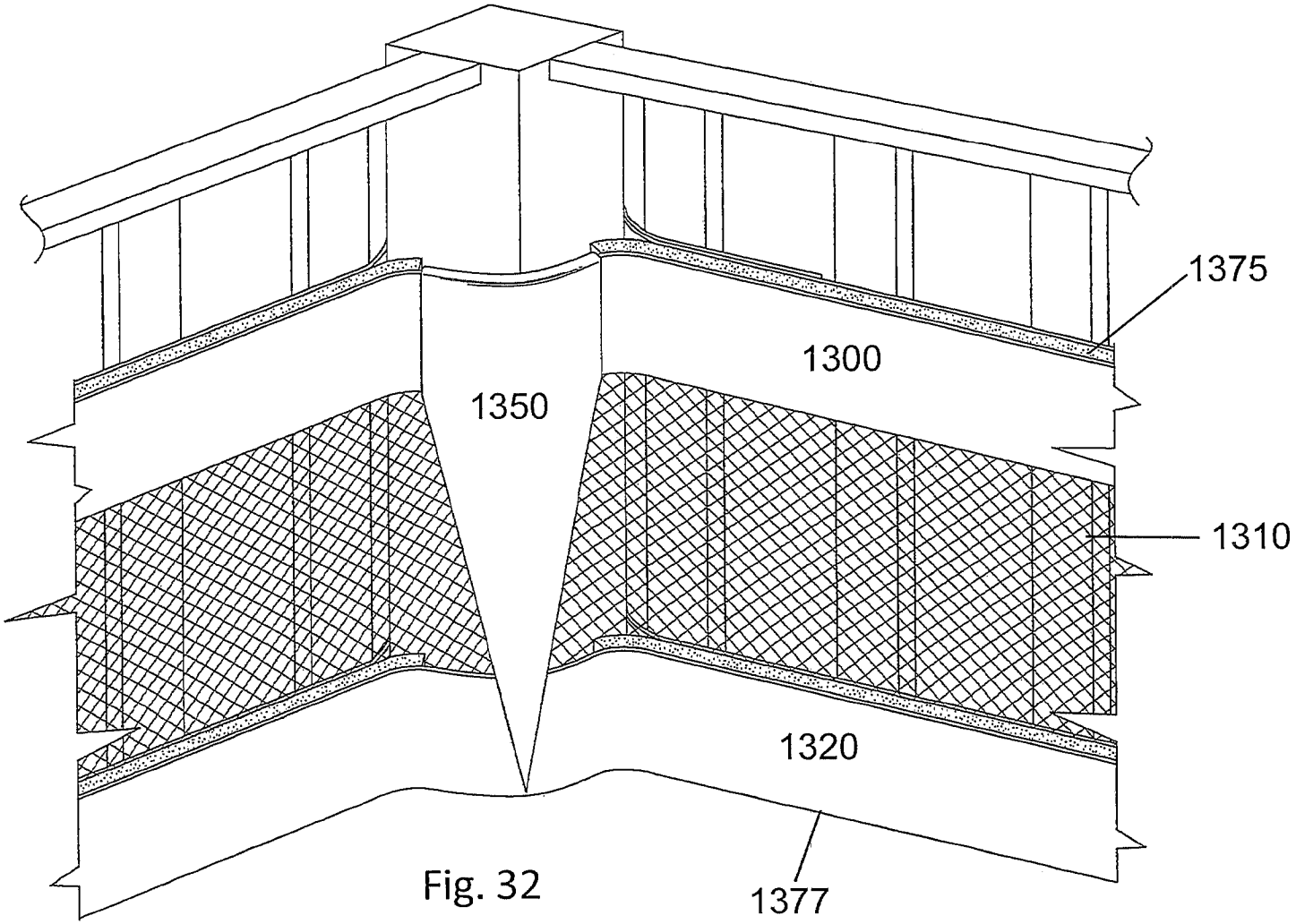
FIG. 32 is a perspective view of an interior of the one corner of the crib showing the crib liner attached thereto.
Figure 33:
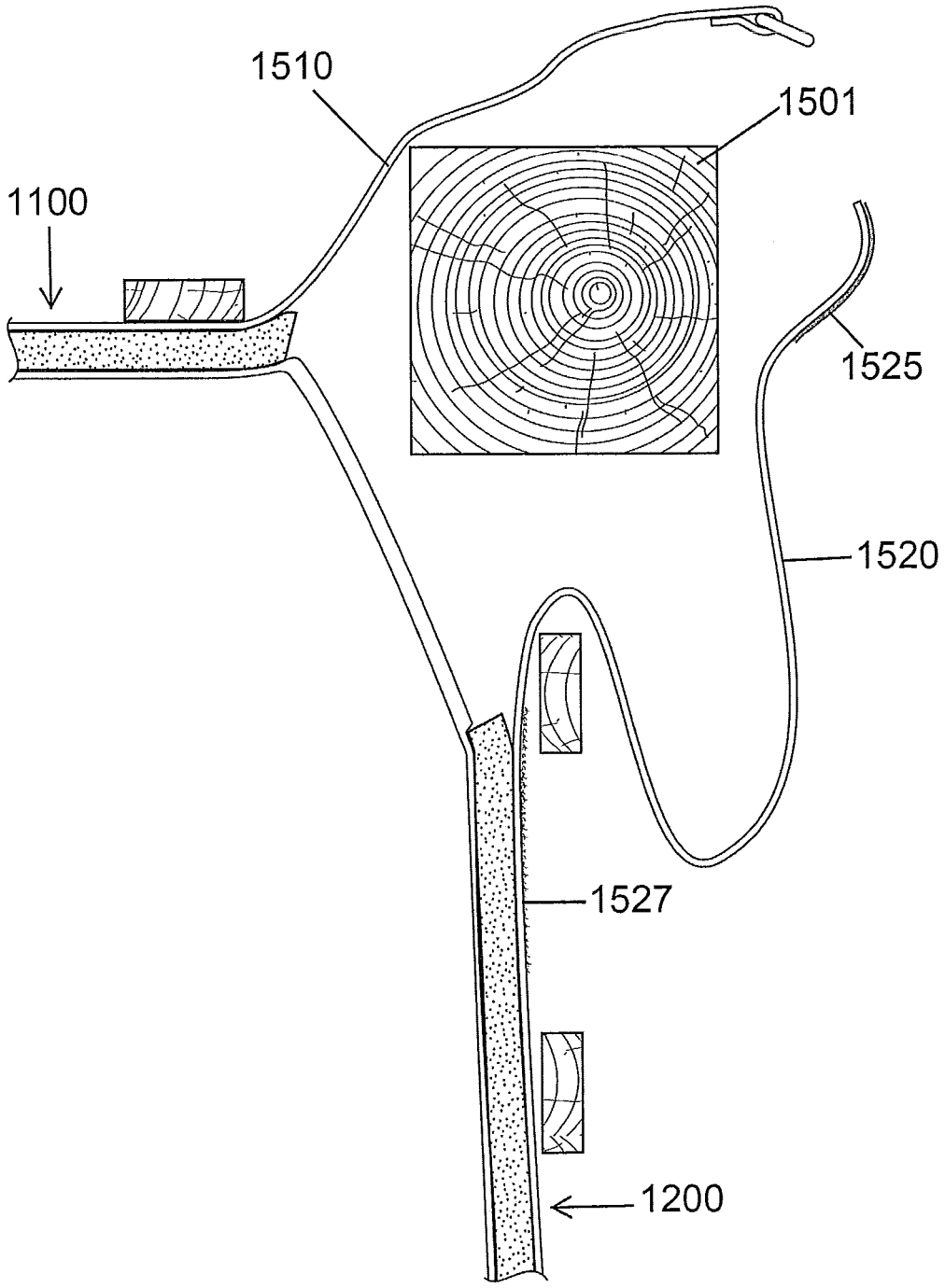
FIG. 33 is a top plan view of the one corner of the crib showing a first step of fastening the crib liner of FIG. 31 to the one corner.

FIGS. 27-30 show the steps for attaching the liner 1000 to a crib frame (i.e., to corner posts thereof). FIG. 27 shows the first and second elements 1400, 1410 pulled outwardly from the sections 1100, 1200 to allow the elements 1400, 1410 to be wrapped around the corner post. FIG. 28 shows the insertion of a distal end 1411 of the second element 1410 through the slit 1405 (of the buckle) after the second element 1410 is wrapped around the corner post of the crib frame. The size of the slit 1405 accommodates the distal end 1411 and allows the second element 1410 to be pulled through the slit 1405. As shown in FIGS. 28 and 29, the second element 1410 is pulled through the slit 1405 and folded over such that the first surface 1402 faces the second section 1200 and more particularly, the fastener 1425 faces and is brought into contact with the fastener 1427 that is part of the section (panel) 1200 so as to securely attach the second element 1410 to the second section 1200. It will be appreciated that the degree to which the second element 1410 extends through the slit 1405 depends upon the dimensions and shape of the corner post. As a result, the second element 1410 is looped around the corner post of the crib and because of the adjustability of the second element 1410, the loop around the corner post can be made very taut so as to securely attach the liner to the corner post.

FIGS. 31-36 show a liner 1500 that is similar to the liner 1000 and therefore like elements are numbered alike. One difference is that in this embodiment, the corner sections 1350 have a slightly different attachment means in that there are a pair of first fastener elements 1510 (as opposed to the single element 1410) and a pair of second fastener elements 1520 (as opposed to the single second fastener element 1420). One element 1510 mates with one element 1520.

The first and second fastener elements 1510, 1520 extend outwardly from the liner with the element 1510 being associated with the side section (panel) 1100 and the elements 1520 being associated with the end section (panel) 1200. As in the previous embodiment, the elements 1400, 1410 are thus wrapped around and secured to the corner post of the crib frame, thereby securely attaching the liner 1500 to the crib in a releasable manner. Each of the elements 1520 includes a fastener 1525 on the first face 1521. The fastener 1525 can be any number of different types of fasteners including the ones described herein. In the illustrated embodiment, the fastener 1525 is a piece of hook and loop material. A fastener 1527 which is complementary to the fastener 1525 (e.g., hook and loop material) is disposed along the second section (panel) 1200. As shown, the fastener 1527 can be formed along the first face 1521 of the element 1520 and/or can be disposed along the exterior surface of the second section 1200.

Figure 34:
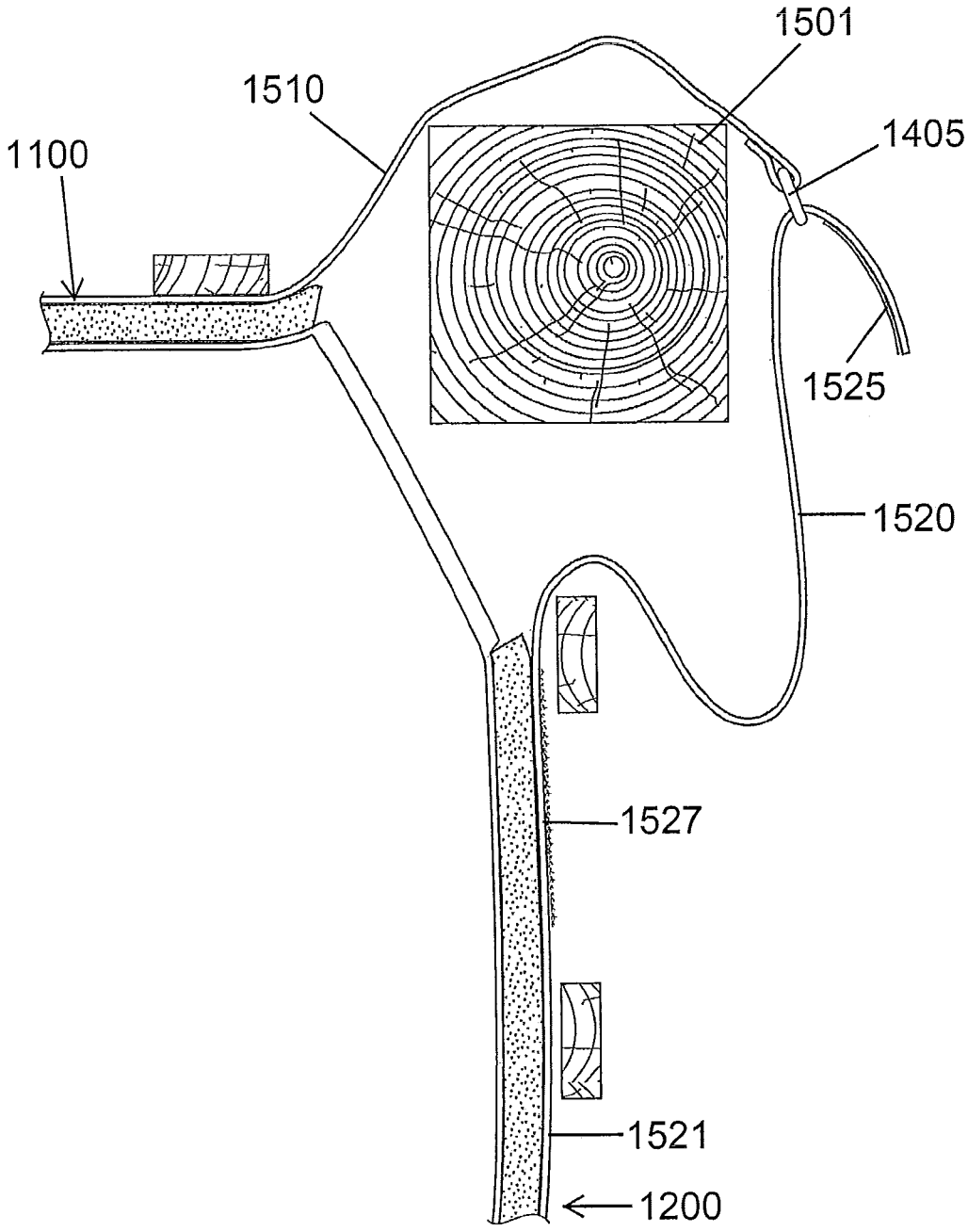
FIG. 34 is a top plan view of the one corner of the crib showing a second step of fastening the crib liner of FIG. 31 to the one corner.
Figure 35:
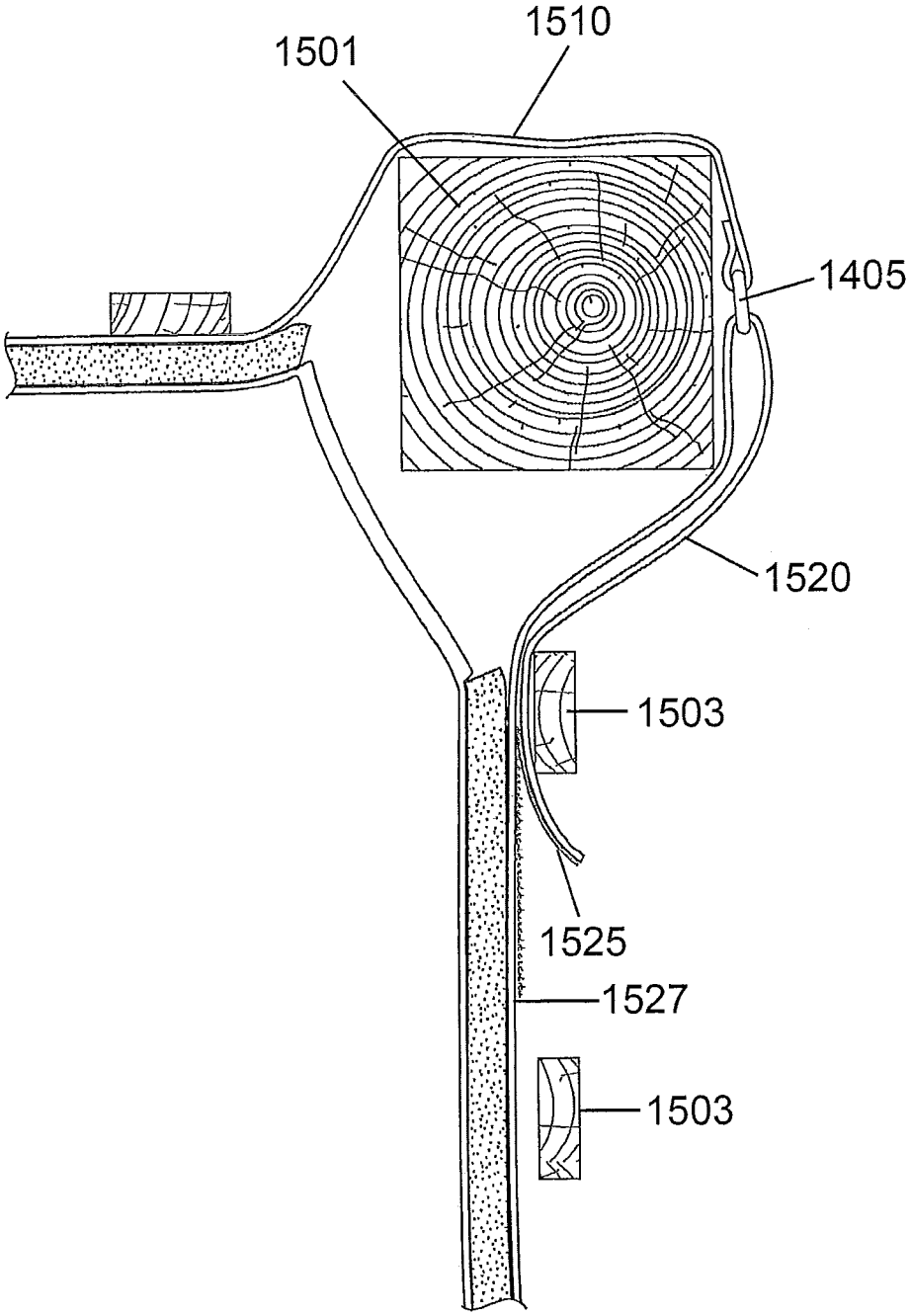
FIG. 35 is a top plan view of the one corner of the crib showing a third step of fastening the crib liner of FIG. 31 to the one corner
Figure 36:
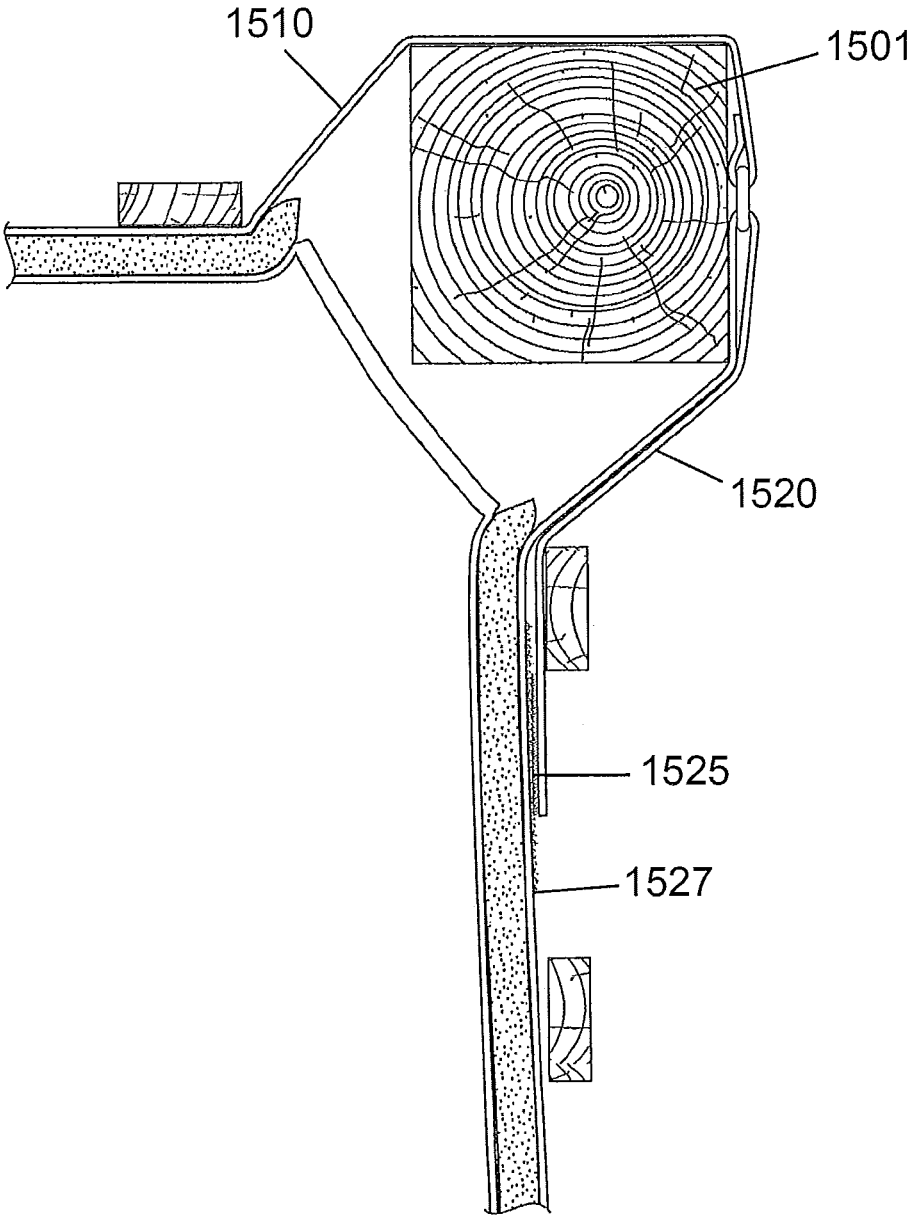
FIG. 36 is a top plan view of the one corner of the crib showing a fourth step of fastening the crib liner of FIG. 31 to the one corner.

FIGS. 33-36 show the steps of attaching the corner section 1350 of the liner 1500 to a corner post 1501 of a crib frame. Similar to the liner 1000, the distal ends of the two elements 1520 are inserted through the slits 1405 formed in the corresponding first elements 1510 as shown in the top plan views of FIGS. 33 and 34. The elements 1520 are then looped back and pulled toward the second section (panel) 1200 of the liner 1500 as shown in FIGS. 34 and 35 so to draw the first elements 1510 snug against the corner post 1501. As shown in FIG. 35, the distal ends of the second elements 1520 can then be routed along the inside of vertical slats 1503 (vertical supports of the crib end) so as to come into contact with the fasteners 1527. The fasteners 1527 have appropriate dimensions to allow the second elements 1520 to be pulled taut against the corner post 1501 as shown in FIG. 36, thereby resulting in the liner 1500 being securely attached to the crib.

Figure 37:
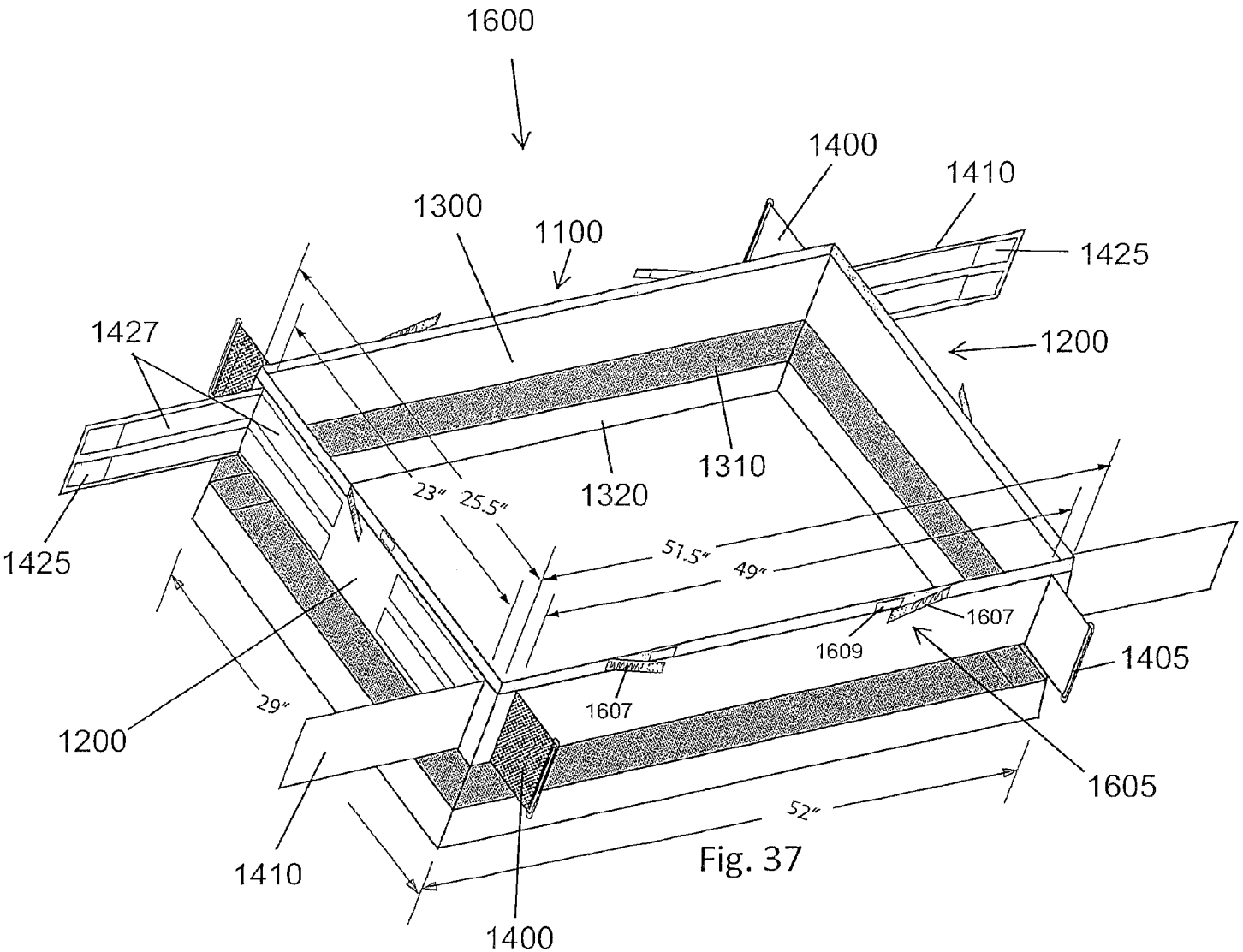
FIG. 37 is a top and side perspective of a crib liner according to one embodiment.
Figure 38:
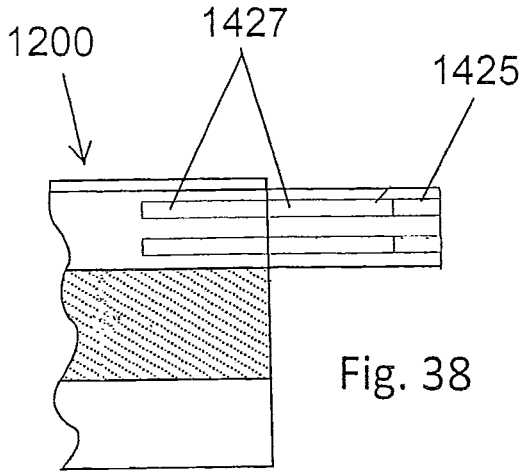
FIG. 38 is a first section of the crib liner of FIG. 37 which defines a part of one corner.
Figure 39:
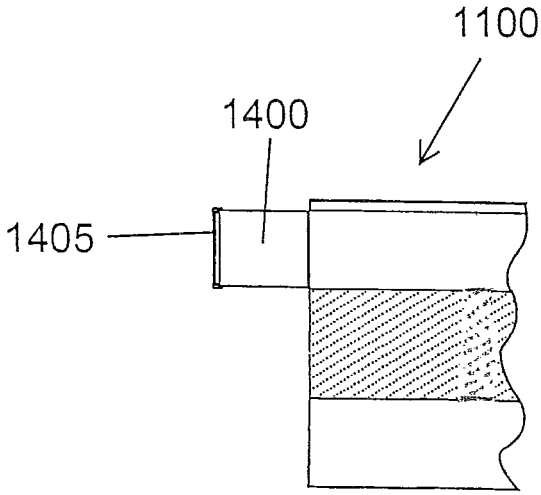
FIG. 39 is a second section of the crib liner of FIG. 37 which defines another part of the corner.

FIGS. 37-39 show a liner 1600 according to another embodiment. The liner 1600 is similar to the previous liners 1000, 1500 and therefore, like elements are numbered alike. The main difference between the liner 1600 and the liner 1000 is that the liner 1600 does not include tapered gusseted corner sections, such as the corner sections 350 that are part of the liner 1000.

The liner 1600 also shows additional attachment means formed along the lengths of the sections 1100, 1200. For example, secondary attachments 1605 can be provided along the upper regions (at or proximate the top edge) of each of the sections 1100, 1200 to provide additional attachment points between the liner 1600 and the crib frame. The secondary attachments 1605 can be in the form of any number of different types of fasteners that serve to attach the liner to a section of the crib. In the illustrated embodiment, each attachment 1605 is in the form of an elongated strip of hook and loop material 1607 that mates with another section of hook and loop material 1609 that is formed along the respective section 1100, 1200. For example, the material 1607 can be an elongated flexible strip of material that is attached to and extends outwardly from the respective side of the section 1100, 1200. The material 1607 is designed to wrap around a portion of the crib, such as one or more vertical support members (slats) 1503 of the crib and be attached to the material 1609 in a taut manner. When the strip 1607 attaches to the material (patch) 1609, an additional attachment point between the liner 1600 and the crib is established.

In the illustrated embodiment, each end section 1200 includes one secondary attachment 1605 and each side section 1100 includes a pair of secondary attachments 1605.

It will be appreciated that the secondary attachments 1605 can also be included as part of the liners 1000 and 1500.

The liner 1600 can incorporate first and second fasteners 1400, 1410 for attaching the liner 1600 to corner posts of the crib. Similar to the constructions described with reference to liner 1000, the fasteners 1400, 1410 can either be attached to the panels 1100, 1200 themselves or they can be part of a corner section that is attached to the ends of the panels 1100, 1200 as described previously.

In the illustrated embodiment, the elements 1400, 1410 are an integral part of the liner material in that they are integral to the fabric material sections thereof and can be in the form of integral extensions that extend outwardly from the liner and fastener elements 1425, 1427 are used to define a looped structure around the corner post of the crib.

FIGS. 24-39 thus broadly show a means for attaching a crib liner that is installed (disposed) along the inside of the crib (i.e., along the inner walls of the crib frame) by using corner attachment means that extend around the exterior of a corresponding corner post. The attachments means accommodates different sized corner posts and allows a secure, taut fit between the liner and crib frame. By disposing the attachment means on the exterior face (surface) of the liner, the attachment means is spaced and removed from an infant that is within the crib.

It will also be appreciated that the elements 1400, 1410 and 1510, 1520 can be reversed in terms of which element is attached to which panel. For example, while the illustrated drawings show the shorter elements 1400, 1510 attached to the side panels and the longer elements 1410, 1520 attached to the end panels, the opposite can be equally true in that the shorter elements 1400, 1510 can be attached to the end panels and the longer elements 1410, 1520 can be attached to the side panels.

It will be understood that all dimensions, such as lengths, mentioned herein and set forth in any drawings attached hereto are merely exemplary in nature and are not limiting of the present invention since the dimensions of the liner of the present invention will vary depending upon different parameters, such as the size of the crib, etc.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A crib liner for a crib that includes four sides and four corner posts, the liner comprising:

a body having two pairs of opposing panel sections for placement along the sides of the crib, each panel section being defined by a top edge and an opposite bottom edge, wherein a length of the top edge is different than a length of the bottom edge for each of the panel sections, the body being configured for placement inside of the crib along inner surface of the sides of the crib; and a plurality of fasteners for attaching the liner to the crib, wherein the liner includes four corner sections that are coupled to the panel sections, with one corner section joining adjacent panel sections, each corner section being defined by an upper section that is defined by parallel side edges that extend to the upper edges of adjacent panel sections and a lower section that is defined by inwardly tapered edges that intersect at the lower edges of the adjacent panels.

2. The crib liner of claim 1, wherein the body has a trapezoidal shape and each fastener is configured to attach around one corner post for securely attaching the liner body to the crib.

3. The crib liner of claim 1, wherein the length of the top edge is less than the length of the bottom edge.

4. The crib liner of claim 1, wherein each panel section includes a mesh section and an adjacent non-mesh section.

5. The crib liner of claim 4, wherein the mesh section occupies less than 50% by surface area of the panel.

6. The crib liner of claim 5, wherein each of the panel sections includes an upper non-mesh section and a lower non-mesh section, with the mesh section being located between the upper and lower non-mesh sections.

7. The crib liner of claim 1, wherein each fastener extends around an exterior surface of the corner post.

8. The crib liner of claim 1, wherein each fastener comprises a looped structure that has an adjustable circumference so as to allow adjustment of the fastener relative to the corner post to cause the fastener to assume a taut condition.

9. The crib liner of claim 1, wherein each fastener includes a first fastener member attached to one panel section and a second fastener member attached to one adjacent panel section, the first and second fastener members being located in one corner of the liner, the first and second fastener members being configured to mate together and capture one corner post.

10. A crib liner for a crib that includes four sides and four corner posts, the liner comprising:

a body having two pairs of opposing panel sections for placement along the sides of the crib, each panel section being defined by a top edge and an opposite bottom edge, wherein a length of the top edge is different than a length of the bottom edge for each of the panel sections, the body being configured for placement inside of the crib along inner surface of the sides of the crib;

a plurality of fasteners for attaching the liner to the crib; and four corner sections that are coupled to the panel sections to form a continuous liner structure, with one corner section joining adjacent panel sections, wherein each fastener is integrally connected to one corresponding corner section, each fastener being defined by a pair of fastener members that are configured to form a looped structure for attaching the liner to one corner post;

wherein the corner sections are separate from the panel sections and are attached thereto along seams;

wherein each corner section is defined by a pair of upper side edges that are opposite one another and terminate at a top edge of the corner section and a pair of lower side edges that are not linear with respect to the upper side edges but instead are tapered with respect to the upper side edges, the fastening members of each respective corner section being attached only to the upper side edges.

11. The crib liner of claim 10, wherein the top edge and bottom edge are measured from between two corner sections attached to opposing ends of the panel section.

12. The crib liner of claim 1, each end of the panel section is defined by a first edge section and a second edge section, the first edge sections being parallel to one another and the second edge sections being parallel to one another but are not parallel to the first edge sections.

13. The crib liner of claim 12, wherein the second edge sections of adjacent panel sections intersect one another at the bottom edges of the panel sections.

14. The crib liner of claim 1, wherein the fastener comprises a first part and a second part, the first part having a length that is passed through an opening associated with the second part to form a looped structure and folded back on top of and secured to a length of the first part.

15. The crib liner of claim 14, wherein the first and second parts include fastening elements in the form of sections of hook and loop material.

16. A crib liner for a crib that includes sides and four corner posts, the liner comprising:

a body having a pair of opposing first panel sections for placement along two sides of the crib and a pair of opposing second panel sections for placement along the other two sides of the crib, the body being configured for placement inside of the crib along inner surfaces of the sides of the crib, the first and second panels sections being coupled to one another to define corners of the body, wherein each of the first and second panel sections includes a top edge, a bottom edge and first and second ends, each of the first and second ends being defined by a first section that intersects and terminates at the top edge and a second section that tapers outwardly from the first section and intersects and terminates at the bottom edge, the first sections being parallel to one another; and a plurality of fasteners for attaching the liner to the crib, each fastener being configured to attach around one corner post for securely attaching the liner body to the inner surfaces of the crib, wherein each fastener includes a first member and a second member being located in one corner of the liner, the first and second members being configured to mate together to define a looped structure that extends around the corner post and has an adjustable circumference so as to capture and accommodate different sized corner posts by adjustment of the circumference of the looped structure.

17. The crib liner of claim 16, wherein first member is attached to one panel section and a second member is attached to an adjacent panel section.

18. The crib liner of claim 16, wherein the liner includes four corner sections that are joined to the panel sections, with one corner section joining adjacent panel sections, wherein the first and second members are integrally connected and form part of the corner section.

19. The crib liner of claim 18, wherein each corner section is defined by an upper section that is defined by parallel side edges that extend to upper edges of adjacent panel sections and a lower section that is defined by inwardly tapered edges that intersect at lower edges of the adjacent panels.

20. The crib liner of claim 16, wherein each panel section is defined by a top edge and an opposite bottom edge, wherein a length of the top edge is different than a length of the bottom edge for each of the panel sections.

21. The crib liner of claim 20, wherein the body has a trapezoidal shape.

22. The crib liner of claim 20, wherein the length of the top edge is less than the length of the bottom edge.

23. The crib liner of claim 16, wherein the first member includes a first fastening element that mates with a second fastening element that is disposed along the first panel section.

24. The crib liner of claim 23, wherein the first and second fastening elements comprise hook and loop material.

25. The crib liner of claim 16, wherein the body is a continuous structure.

26. The crib liner of claim 16, wherein bottoms of the opposing second sections of adjacent first and second panel sections taper outwardly toward one another so as to define a point along the bottom edge.

27. The crib liner of claim 16, wherein the first section intersects the top edge at a right angle.

* * * * *